United States Patent [19]

Quenzi et al.

[11] Patent Number: 4,930,935

[45] Date of Patent: Jun. 5, 1990

[54] SCREEDING APPARATUS AND METHOD

[75] Inventors: Philip J. Quenzi, Atlantic Mine, Mich.; David W. Somero, Wheeler Rd.; Paul J. Somero, both of New Ipswich, N.H. 03071

[73] Assignee: David W. Somero; and Paul J. Somero, New Ipswich, N.H.

[21] Appl. No.: 291,678

[22] Filed: Dec. 29, 1988

[51] Int. Cl.[5] ..... E01C 19/40

[52] U.S. Cl. ..... 404/75; 404/114; 404/118

[58] Field of Search ..... 404/75, 84, 101, 102, 404/113–115, 118, 120; 425/60, 446, 456; 264/31, 293, 310

[56] References Cited

U.S. PATENT DOCUMENTS

| | | | |
|---|---|---|---|
| 1,782,707 | 11/1930 | Bayley | 404/114 X |
| 2,146,101 | 2/1939 | Weber | 404/121 |
| 2,306,671 | 12/1942 | Tamblyn | 404/119 |
| 2,346,378 | 4/1944 | Jackson | 404/114 |
| 2,746,366 | 5/1956 | Reed | 404/120 |
| 3,221,618 | 12/1965 | Hudis | 404/106 |
| 3,247,770 | 4/1966 | Perkins et al. | 404/114 |
| 3,309,971 | 3/1967 | Domenighetti | 404/118 |
| 3,412,658 | 11/1968 | Griffin | 404/119 |
| 3,450,011 | 6/1969 | Godbersen | 404/122 |
| 3,453,939 | 7/1969 | Pollitz et al. | 404/84 |
| 3,526,173 | 9/1970 | Brandstetter et al. | 404/108 |
| 3,541,931 | 11/1970 | Godbersen | 404/122 |
| 3,541,932 | 11/1970 | Hodson | 404/102 |
| 3,550,511 | 12/1970 | Potts | 404/108 |
| 3,602,112 | 8/1971 | Burks | 404/118 |
| 3,602,115 | 8/1971 | Hanson | 404/105 |
| 3,604,512 | 9/1971 | Carter et al. | 172/4.5 |
| 3,636,832 | 1/1972 | Schrimper et al. | 404/84 |
| 3,638,540 | 2/1970 | Williams | 404/84 |
| 3,779,661 | 12/1973 | Godbersen | 404/72 |
| 3,779,662 | 12/1973 | Smith | 404/98 |
| 3,816,014 | 6/1974 | Klopf | 404/114 |
| 3,841,777 | 10/1974 | Domenighetti | 404/84 |
| 3,873,226 | 3/1975 | Teach | 404/84 |
| 3,907,451 | 9/1975 | Fisher et al. | 404/101 |
| 3,953,145 | 4/1976 | Teach | 404/84 |
| 3,959,977 | 6/1976 | Godbersen | 425/63 |
| 4,073,592 | 2/1978 | Godbersen et al. | 404/89 |
| 4,266,917 | 5/1981 | Godbersen | 425/64 |

(List continued on next page.)

FOREIGN PATENT DOCUMENTS 1093166 5/1955 France .

OTHER PUBLICATIONS

Spectra-Physics, Product Information Brochure, Model BL9 Blade Leveler Unit, copyright Sep. 1984 with attached drawing dated Feb. 2, 1982.

(List continued on next page.)

*Primary Examiner*—Jerome W. Massie, IV
*Assistant Examiner*—Matthew Smith
*Attorney, Agent, or Firm*—Price, Heneveld, Cooper, DeWitt & Litton

[57] ABSTRACT

An apparatus and method are disclosed for pivoting a screed assembly during screeding of placed and/or poured, uncured concrete or like loose, spreadable materials to maintain proper screeding contact by the screeding assembly with the concrete or like material by counteracting the force of concrete or other like material acting against the screed assembly as it is moved along the concrete. The apparatus includes a support, preferably of the self-propelled type, a boom and boom mount, and a pivot between the boom and the screed assembly. The axis of the pivot extends generally perpendicularly to the screeding direction in which the screed sassmblyis moved. A power source, such as a pair of fluid cylinders, rotates the screed about the pivot axis, preferably in response to an electro-hydraulic leveling sensor mounted on the screed. The lateral incline of the screed perpendicular to the screeding direction may be controlled about additional pivot axes orthogonal to the first. A power operated elevation control is preferably responsive to a fixed laser beam reference plane positioned externally of the screed assembly. The boom is telescoping and has multiple sections for extending and retracting the screeding assembly with respect to the support. The screed preferably includes a vibration assembly vibrationally isolated from the remainder of the screed for smoothing the concrete.

62 Claims, 13 Drawing Sheets

U.S. PATENT DOCUMENTS

| | | | |
|---|---|---|---|
| 4,340,351 | 7/1982 | Owens | 425/456 |
| 4,349,294 | 9/1982 | Allen | 404/110 |
| 4,371,287 | 2/1983 | Johansson | 404/84 |
| 4,466,757 | 8/1984 | Allen | 404/114 |
| 4,470,783 | 9/1984 | Friebel et al. | 425/62 |
| 4,484,834 | 11/1984 | Rowe et al. | 404/84 |
| 4,655,633 | 4/1987 | Somero et al. | 404/75 |

OTHER PUBLICATIONS

Waterman Hydraulics product brochure, Series 12DS-Solenoid Operated Directional Control Valves, Nov. 1985.

Laser Screed brochure, "A Revolution in Concrete Floor Technology", by Laser Screed, Inc., Mississauga, Ontario, published (distributed publicly) Mar. 18, 1988.

Laser Screed brochure, Laser Screed, Sheffield, England, published (distributed publicly) Sep. 19, 1988.

Laser Screed brochure, Priboma BV, Bergeijk, Netherlands, published (distributed publicly) May 1, 1988.

Ford Industrial Buyer's Guide, 1984–85, Ford Motor Company.

Sifco Bearings brochure, 1984, Sifco Bearings, subsidiary of Sifco Industries, Inc., Avon, OH 44011, including drawing dated May 6, 1985.

Spectra-Physics, Product Information, Models, R2S, R2N Prinz Albert Receiver, copyright Sep. 1984, Dayton, OH 45424.

Spectra-Physics, Product Information, Model CB2OTO Rigid/Manual Mast Control Box, copyright Sep. 1984, Dayton, OH 45424.

Spectra-Physics, Product Information, Model 1044-L Long-Range Electronic Level, copyright Jan. 1985, Dayton, OH 45424.

Spectra-Physics, Product Information, Model UV9-30-XX Unloading Valve, copyright Aug. 1984, Dayton, OH 45424.

Spectra-Physics, Proc/Spec, Installation Procedure, regarding 4-way, GPM cc valve, drawings dated Nov. 19, 1984 and Feb. 14, 1985, Dayton, OH 45424.

Gresen Directional Control Valves, V20 brochure, Gresen Mfg. Co., subsidiary of Dana Corp., Minneapolis, MN 55440, May 1981.

Lord Industrial Products, Center Bonded Mounts (CB-1100 Series), Safetied Tube Form Mounts (STA Series), 1983, Lord Corp., Industrial Products Div., Erie, PA 16514-0039.

Ausco, Failsafe Brakes for Hydrostatic Drives, Feb. 1985, Auto Specialties Mfg. Co., St. Joseph, MI 49085.

Helland, Series 800 S.A.E. C, Model 815-14S, 1984, Helland Research & Engineering Inc., Plymouth, MN 55441-3499.

Morrison's High Frequency Vibrating Screeds, Morrison's Concrete & Equipment, Inc., Charlotte, NC 28214, Feb. 1984.

Metal Forms Corporation Speed Screed Advertisement, Milwaukee, WI 53212, from "Concrete Construction" magazine, Apr. 1985.

Making Quality Number 1 Makes The Customer Number One, Concrete Construction, Apr. 1985.

Bid-Well Concrete Finishers ad, from "Concrete Construction" magazine, Apr. 1985.

Allen Concrete Equipment, Allen Engineering Corporation, Paragould, AZ 72451.

The AWS Multi-Purpose Floor System Equipment Package, AWS Manufacturing, Inc., Yorkville, IL 60560.

The Growing Gomaco Line, Gomaco Corporation, Ida Grove, IA 51445, Brochure No. G-0577-02 and Gomaco ads regarding pavers, finishers and screeds from "Concrete Construction" magazine, Feb. and Apr. 1985.

Speed Screed, A Concrete Finisher That's Built to Last, Metal Forms Corporation, Milwaukee, WI 53212, copyright 1982.

For Concrete of Epoxy Use . . . Maginniss Vibratory Finishers, Model SSVF, Maginnis Vibrator Equipment Company, Mansfield, OH 44901.

Texas Vibratory Screed, "New Model 20", H. Compton Company, Conroe, TX 77301.

Self Propelled Concrete Roller Screeds, J. D. Concrete Screed, La Habra, CA 90631.

Danco Vacuum Concrete Corporation, San Francisco, CA 94107.

The AWS Concrete Screed, AWS Manufacturing Inc., Naperville, IL 60540.

Striker, Bunyan Industries, Salt Lake City, UT 84115.

The Screen That Walks . . . , Cronkhite Industries, Inc., Westville, IL 61883.

Article Repaving Mount Vernon Highway, Virginia, Concrete Construction, Feb. 1984.

Atlantic NewCem Profile, Concrete Construction, Feb. 1984.

Rexworks Inc., Milwaukee, WI 53201.

Northrup Concrete Screeds, Northrup Mfg. Co., St. Louis, MO 63110.

TO HYDRAULIC PUMP AND RESERVOIR

SCREEDING APPARATUS AND METHOD

BACKGROUND OF THE INVENTION

This invention relates to methods and machines for screeding that is, spreading, distributing and smoothing and/or leveling placed and/or poured, uncured concrete or like loose, spreadable material such as sand and gravel, or relatively viscous, fluid materials. More particularly, the invention concerns an apparatus and method for screeding such materials without the use or need for prepositioned guides or rails, especially rail guided paving or screeding machines such as slip-form pavers. The invention is an improvement of an earlier apparatus and method for screeding such materials with a device positioned either adjacent the uncured concrete or driven through the uncured concrete while screeding.

The present invention is an improved version of the screeding apparatus and method of U.S. Pat. No. 4,655,633 assigned to the assignees of the present invention. In the device and method of U.S. Pat. No. 4,655,633, a self-propelled apparatus includes a steerable, self-propelled frame, a cantilevered boom, and an auger-type, vibratory screed mounted on the boom for spreading and smoothing the concrete as the screed was moved toward the vehicle. The elevation of the screed is adjusted automatically by a screed control assembly relative to a laser beacon reference plane positioned off the apparatus such that the finished height of the concrete or other material was accurately controlled within close tolerances. The vibratory screed of U.S. Pat. No. 4,655,633 also includes a rotatable auger for spreading the concrete or other material laterally with respect to the direction of movement of the screed, as well as a strike-off member for engaging the concrete behind the auger, both of which were vibrated by a screed vibration assembly on the same support.

Other screed assemblies have included striker blades spaced in front of screed vibration assemblies including certain assemblies used with the apparatus of U.S. Pat. No. 4,655,633, and others such as those shown in U.S. Pat. Nos. 3,541,932 and 3,907,451. The structures of the latter two patents also incorporate augers positioned in front of the striker and screed vibration assemblies. It has been found that such prior devices tended to push concrete in front of the blade or striker. The buildup of concrete in front of the striker blade exerted a horizontal force on the screed assembly, tending to deflect the screed and raise the trailing vibratory screed portion out of the concrete surface. This caused tearing of the surface and consequent roughness because of the lack of smoothing with the vibratory assembly. Hence, it was necessary in many cases to rescreed the same area multiple times thereby increasing the cost and expense for finishing the concrete.

In another aspect of U.S. Pat. No. 4,655,633, the striker member and auger were simultaneously vibrated in unison by a screed vibrating assembly. However, such simultaneous vibration of all parts of the screed assembly contacting the concrete tended to produce roughness and prevent fine, precisely controlled grading or leveling of the concrete areas.

Further, the screed assembly of U.S. Pat. No. 4,655,633 was carried on a truss-type boom assembly of fixed length which, although capable of being extended or retracted, normally protruded from the operator platform of the apparatus. In close quarters in smaller buildings where concrete was being installed, the fixed length boom created problems in maneuvering the screeding apparatus from one area to another, as well as preventing complete withdrawal of the boom and screed assembly to a position close to the screeding apparatus. This prevented maximum efficiency in using the apparatus in such small areas.

Accordingly, the present invention was principally devised to improve the placement and/or finishing of both large and small poured concrete areas by improving the efficiency of the contact of the screeding assembly with the concrete or other material to be spread during screeding operations, and by coupling the screeding assembly with a support boom which could be more easily extended and retracted, especially in confined areas, thereby making the apparatus more easily operated.

SUMMARY OF THE INVENTION

The present invention is an improved screeding apparatus and method for spreading, distributing, smoothing, leveling and/or grading placed and/or poured, uncured concrete or like loose, spreadable, viscous fluid or plastic materials on the ground or on suspended decks, parking structures or other surfaces to allow finishing of the concrete or other material without the use of large slip-form pavers or other apparatus requiring the use of preset guides or rails.

In one aspect, the invention is an improved screeding apparatus for such concrete or other material of the type including a support for supporting the apparatus on the ground or a support surface, a boom extending outwardly from the support, boom support means for mounting the boom on the support, a screed assembly, and a screed mount for mounting the screed assembly on the boom. The improvement includes a screed assembly which is elongated and includes a striker for engaging and spreading the material to be spread, rotatable auger means for moving the material along the auger means in the direction of elongation of the screed assembly, and vibration means for engaging, vibrating and smoothing the material. The striker and vibration means are spaced on opposite sides of the auger means. Articulated means are provided for pivotally mounting the screed assembly on a first pivot axis extending generally parallel to the direction of elongation of the screed assembly. The pivot axis is generally vertically aligned with the auger means. Motive power means are included for pivoting the screed assembly about the pivot axis such that contact of the striker and vibration means with the concrete or other material may be varied during screeding.

Preferably, the apparatus includes means for moving the elongated screed assembly along and over the concrete in a direction generally perpendicular to its direction of elongation. The motive power means allow pivoting of the screed assembly to counteract the force of concrete or other material engaging the striker during movement and to maintain proper screeding contact of the assembly with the concrete. Such means for moving the elongated screed assembly may include either a power operated, telescoping boom assembly or a self-propelled frame on which the boom, screed assembly, operator platform and associated equipment are mounted.

In one preferred embodiment, the screeding apparatus includes elevation means for raising and lowering the screed assembly with respect to the boom, which elevation means are operable in response to a fixed laser beacon reference plane to precisely control the elevation and grade of the concrete or other material being finished. In such form, the apparatus includes spaced elevation tubes secured to the screed assembly at opposite ends and power means for raising and lowering the elevation tubes. One of the elevation tubes is secured to the screed assembly at one end about the first pivot axis as well as a second pivot axis while the other of the elevation tubes is secured to the opposite end of the screed assembly about the first pivot axis and a third pivot axis extending parallel to the second pivot axis. In this manner, the lateral tilt of the screeding assembly in a plane generally perpendicular to the direction of movement of the screed may be controlled as well as the rotational position of the screeding assembly about the first pivot axis.

Preferably, level sensing means are included on the screed assembly for sensing the position and degree of rotation of the screed assembly about the first pivot axis along with control means responsive to the level sensing means for actuating the motive power means to pivot the screed about the first pivot axis. In addition, the screeding assembly may include means for vibrationally isolating the vibration means from the remainder of the screed assembly such that vibration may be provided without affecting the operation of the auger and/or striker.

In the preferred embodiment, the telescoping boom assembly includes a plurality of boom sections movable with respect to one another and with respect to the support. The screed assembly is mounted at one end of one of the movable boom sections while boom power means are provided for extending and retracting the boom sections and thus the screed assembly. Preferably, the boom power means include a fluid cylinder for extending and retracting one section with respect to the support, as well as pulley and cable means on the one boom section and a second boom section for extending and retracting the second boom section with respect to the first boom section and the support when the fluid cylinder is operated.

In addition, a method of screeding placed and/or poured concrete or like material with a screed assembly is provided including moving the screed assembly through the concrete in a predetermined direction to spread, grade and smooth the concrete or other material while pivoting the screed assembly about an axis perpendicular to the predetermined direction during such movement to counteract the force of concrete or other material acting on the screed assembly and to maintain effective screeding contact of the screed assembly with the concrete or other material during such movement.

Accordingly, the present screeding apparatus and method provide improvements and advantages over prior known screeding structures and methods. The articulated mounting of the screed assembly about a pivot axis extending generally perpendicular to the direction of movement of the screeding assembly allows rotation of the screeding assembly during operation to counteract the force of concrete or other material building up in front of the moving screed to maintain proper contact of the striker, auger and vibratory portions of the screed to create a uniform, accurately graded, finished surface on the concrete. Isolation of the vibrating screed portion from the remainder of the auger and striker in the screed allows proper grading and leveling of the concrete while the vibrating portion properly finishes the fluid concrete. In addition, the combined improved screeding assembly and telescoping boom allows positioning and movement of the overall assembly in restricted, more confined areas. This allows use of the apparatus in a wider variety of buildings and other structures which would not previously admit screeding apparatus. Time consuming, expensive hand placing operations are thus avoided in a larger number of cases. Overall, the quality of placed and finished concrete or other material processed with the apparatus and method is higher and more accurately graded than that previously known.

These and other objects, advantages, purposes and features of the invention will become more apparent from a study of the following description taken in conjunction with the drawings.

BRIEF DESCRIPTION OF THE DRAWINGS

FIG. 15 is a side elevation of the assembly of

FIG. 14 taken along line XV—XV of FIG. 14;

DESCRIPTION OF THE PREFERRED EMBODIMENTS

Overall Assembly

Figure 1:
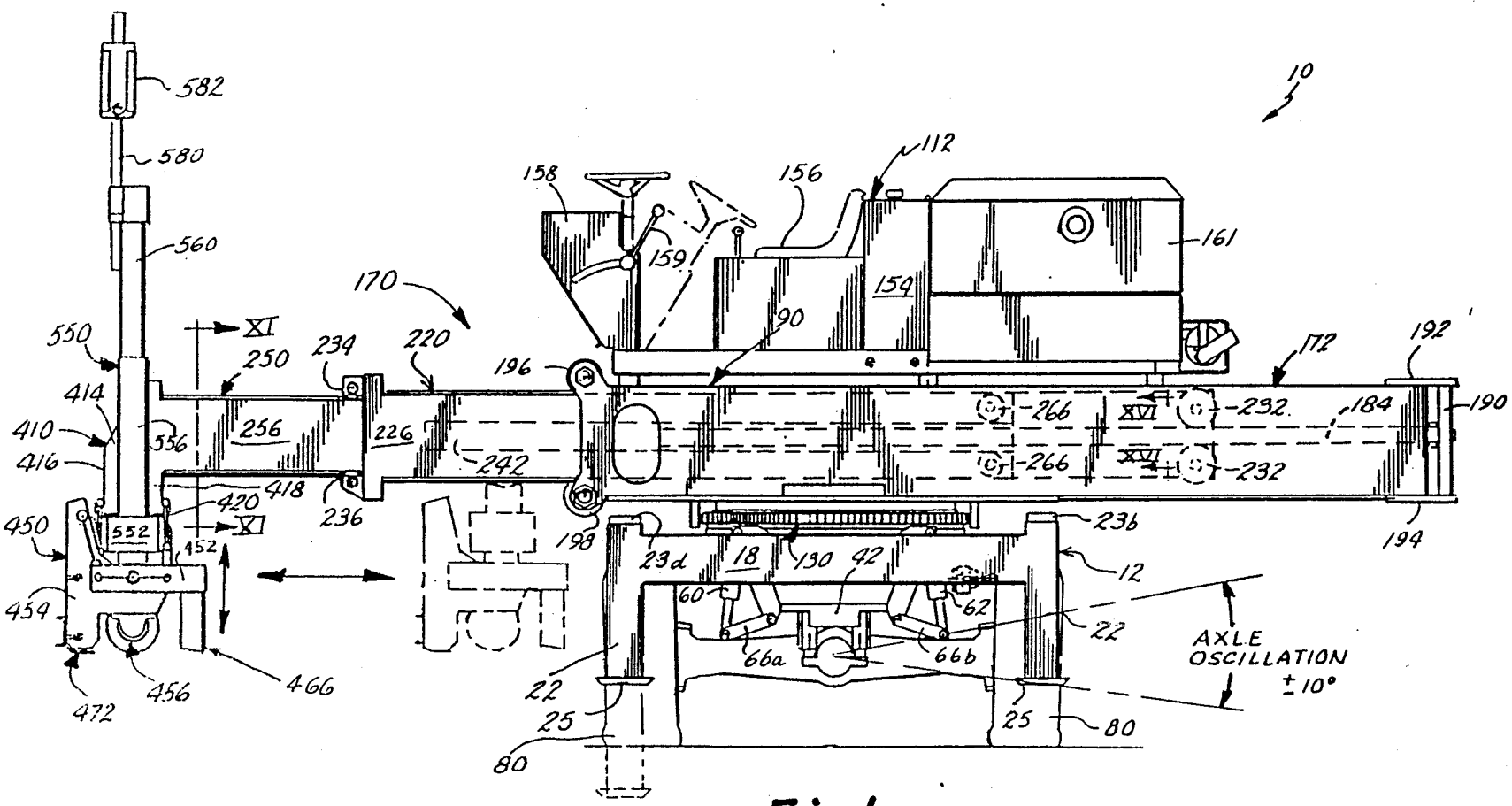
FIG. 1 is a side elevation of the screeding apparatus of the present invention, the boom and screeding assembly being rotated such that the self-propelled supporting frame is shown in end view.

Referring now to the drawings in greater detail, FIGS. 1–4 illustrate a preferred form of an improved, self-propelled screeding apparatus 10 embodying the present invention. Screeding apparatus or machine 10 is a revised, improved version of the prior machine of U.S. Pat. No. 4,655,633 entitled "SCREEDING APPARATUS AND METHOD", the disclosure of which is hereby incorporated by reference. Like the earlier machine, machine 10 is also designed for finishing concrete or other materials in restricted or open areas, but is particularly advantageous in areas in which it is inconvenient to lay support rails or guides and/or position large, rail supported screeding apparatus or slipform pavers. The present machine is also highly useful for finishing large areas of concrete since it avoids the necessity of laying a first strip which must harden before an adjacent strip can be poured and finished. In addition, the present machine provides improved leveling, grading and screeding efficiency while providing a more compact apparatus which may be positioned and more easily used within confined areas in which concrete is to be laid.

As shown in FIGS. 1–4, machine 10 includes a lower support frame 12 having front and rear propulsion support axles 50, 70 each of which provides both propulsion and steering capability, four support wheels 80 preferably including rubber tires, an upper frame 90 which is rotatable on a large bearing 130 and includes an operator support platform 112 along with an engine/hydraulic pump compartment 161. Appropriate controls for the machine are positioned on a tiltable instrument/steering console 158 which may be locked with locking handle 159 either in an operating position (shown in phantom in FIG. 1) or an upright withdrawn position allowing entry of the operator. Additional controls 160*a*, 160*b* are located on the left and right of the driver's seat. The upper frame 90 also provides support for the telescoping boom assembly 170.

Boom 170 extends outwardly from upper frame portion 90 below the operator's platform 112 and is mounted for horizontal, telescoping extension and retraction on suitable bearings. On the outer, free end of boom assembly 170 is a screed mounting assembly 410 to which screed elevation assembly 550 is attached. A screed assembly 450 is, in turn, mounted for raising and lowering on elevation assembly 550. The automatic screed elevation control system, preferably using laser beacon receivers 582, is included on screed elevation assembly 550 and is connected to an appropriate control mounted on operator platform 112 on upper frame portion 90. By means of the rotatable upper frame portion 90, boom 170 carrying screed mounting assembly 410, screed assembly 450 and screed elevation assembly 550, may be rotated 360 degrees around lower frame 12 for spreading, distributing, smoothing and/or leveling, i.e., screeding the placed and/or poured, uncured concrete adjacent the machine.

As explained hereinafter, the boom may be rotated such that it extends rearwardly behind frame 12 and axle 70 with screed assembly 450 positioned behind the rear support wheels 80 and axle 70. In this configuration, machine 10 may be driven through placed and/or poured, uncured concrete with the smoothing and finishing proceeding behind the rear wheels as the apparatus moves slowly through the concrete. Any tracks are filled in as the concrete or other material is smoothed therebehind.

The principal changes in the present improved screeding apparatus and method are more fully described hereinafter and include four-wheel drive with two hydraulic motors allowing variable speed and drive power, a larger operating engine, a revised hydraulic pump, a revised operator's platform and instrument panel, a telescoping boom assembly including a roller hose/cable support guide and related hydraulics instead of a rigid, truss-type boom, as well as a revised screed assembly which is pivotable on orthogonal axes and preferably includes a revised vibratory screed with related hydraulic controls and improved screed deflection adjustment assembly as well as a single auger operated by a single hydraulic motor.

For purposes of the present application, the apparatus and method described will be understood to principally refer to the placement, i.e., screeding, of previously poured, uncured concrete or like loose, spreadable material such as sand, gravel, asphalt or other viscous fluid materials previously placed on the ground or on other surfaces such as in parking ramps, on decks, in buildings or the like. The present apparatus and method is especially useful in low slump, uncured concrete. It will be recognized, however, that the present apparatus and method avoids the use of prepositioned guide rails or supports for screeding apparatus thereby eliminating significant amounts of labor and expense in the concrete finishing operation.

Support Frame, Propulsion System, Operator's Platform And Hydraulic Swivel

Figure 2:
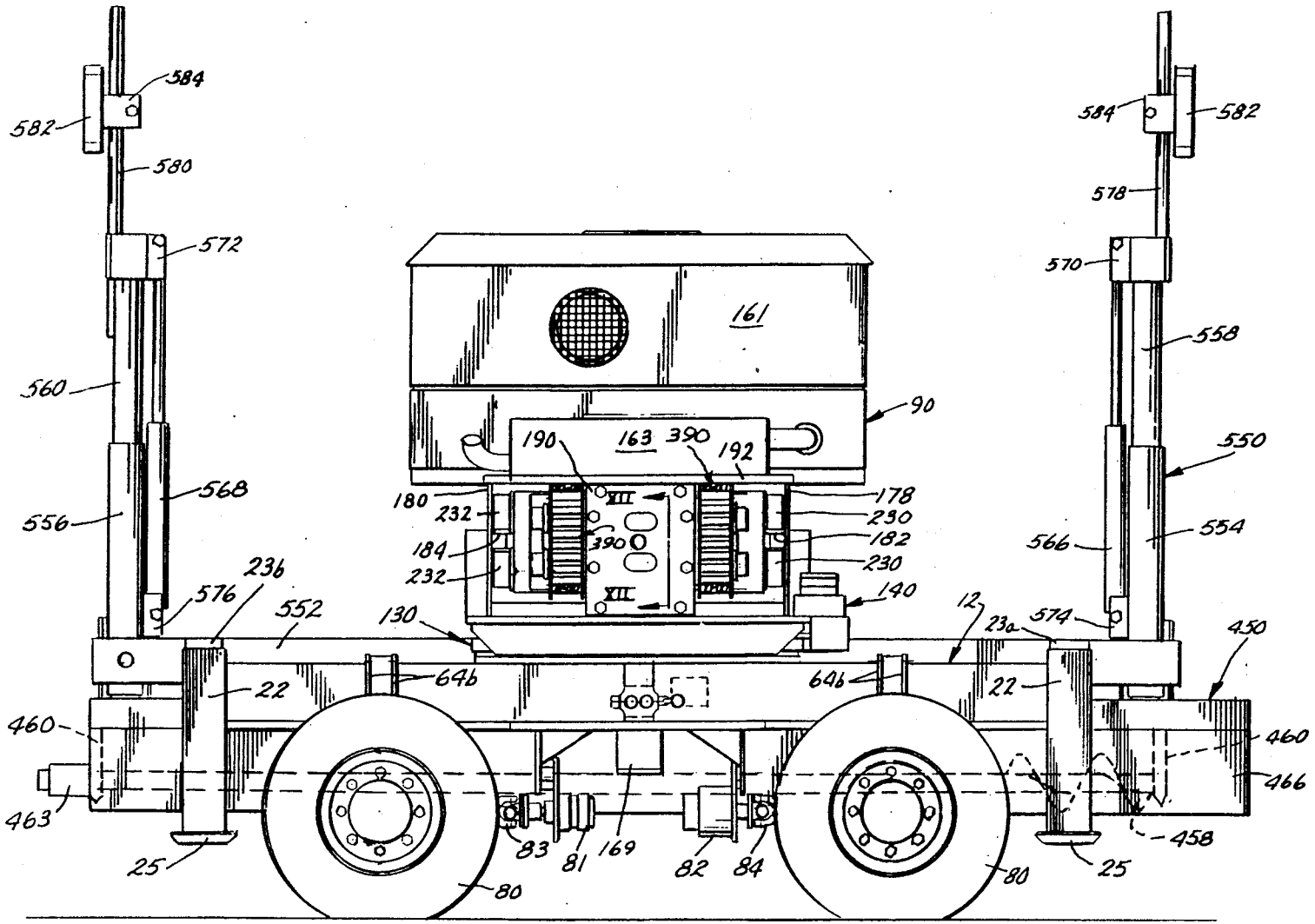
FIG. 2 is an end elevation of the screeding apparatus shown in FIG. 1 with the boom and screeding assembly being rotated such that the self-propelled supporting frame is shown in side elevation.
Figure 3:
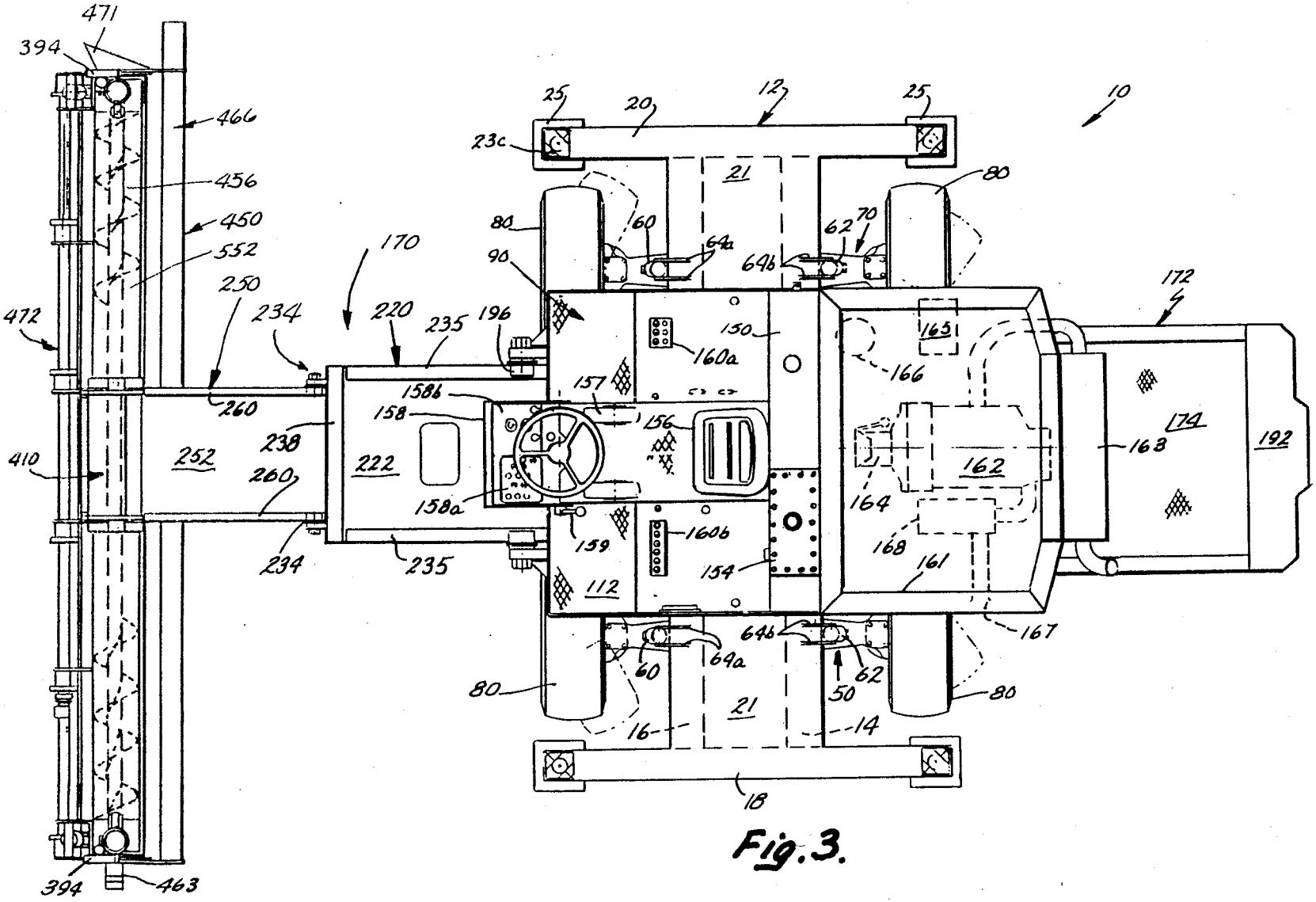
FIG. 3 is a top, plan view of the screeding apparatus shown in FIGS. 1 and 2.

Referring now to FIGS. 1–3, the lower support frame 12 is substantially similar to the lower support frame of U.S. Pat. No. 4,655,633 and includes a rigid framework formed from a pair of parallel, box section, tubular, longitudinal steel beams or frame members 14, 16 covered by steel decking 21 and front and rear beams or frame members 18, 20 extending across the ends of beams 14, 16. Four stabilizer leg mounting tubes 22, one at each end of lateral frame members 18, 20, extend downwardly for receipt of extendable stabilizer leg cylinders 23*a*–23*d*. Rotational bearing 130 is mounted centrally on support beams 14, 16 between those beams and the upper frame 90 for rotational support of the upper frame including operator platform 112 and screed support boom 170. Bearing assembly 130 is substantially similar to that described in U.S. Pat. No. 4,655,633 and is powered by a hydraulic rotation motor 140 (FIG. 2) which rotates the upper framework 90 with respect to the lower framework 12 through 360 degrees. Like propulsion motors 81, 82 described below, motor 140 includes a spring loaded, pressure released, "fail safe" brake to prevent rotation except when the hydraulic system is operated.

Hydraulic stabilizing leg cylinders 23*a*–23*d* include ground engaging foot plates 25. A pair of the cylinders on one side of the apparatus are operable in unison with the vehicle hydraulic system, while the two remaining stabilizer cylinders on the opposite side may be lowered independently of one another as controlled by the operator. This allows the apparatus to accommodate variations in ground height and provides a triangular configuration when raising/leveling the vehicle to accommodate such irregularities. As in U.S. Pat. No. 4,655,633, a control valve for stabilizer cylinders 23 includes fluid lock valves to prevent escape of hydraulic fluid therefrom to prevent undesired retraction of those cylinders during operation of the machine while in a working position.

Front and rear axle assemblies 50, 70 are supported on downwardly extending brackets 42 (FIG. 1) secured to lower beams 14, 16. Each of the axle assemblies is a drive/steer axle substantially similar to that used in U.S. Pat. No. 4,655,633. Each of the axle assemblies 50, 70 is preferably pivotally mounted on support brackets 42 for oscillation about a horizontal axis in a vertical plane. Each axle may oscillate through approximately 10 degrees both above and below the horizontal such that the screeding apparatus 10 may accommodate sloped terrain while the operator's platform is kept generally level. Locking to prevent oscillation of drive/steer axles 50, 70 when in a working position is provided by hydraulic, axle oscillation locking cylinders and/or links 60, 62 pivotally mounted on each axle between support flanges 64*a*, 64*b* rigidly secured upwardly and outwardly from framework beams 14, 16 and a pair of lower pivot links 66*a*, 66*b* which are pivotally mounted on either side of axle support brackets 42 (FIGS. 1 and 2). When hydraulic lock cylinders 60, 62 are extended, the outer ends of links 66*a*, 66*b* are pressed against the top surface of the axle assemblies on either side of the central pivot axis to lock the axle in the desired position and prevent it from further oscillation until the lock cylinders are released.

Each of the axles also includes a tie rod (not shown) for control of wheels 80 in unison on either end thereof by the vehicle operator. Pivotal movement of the tie rods and wheels is controlled by hydraulic steering cylinders (not shown) substantially similar to those in U.S. Pat. No. 4,655,633 which are connected to the vehicle hydraulic system. The ability to steer the wheels on both axles in four-wheel, two-wheel or crab configuration makes the apparatus highly maneuverable in small areas such that boom 170 and screed 450 can reach a variety of areas.

As is best seen in FIG. 2, a pair of hydraulic propulsion motors 81, 82, one for each of front and rear axles 50, 70, are connected to separate drive shafts for axles 50, 70. The drive shafts include universal joints 83, 84. Motors 81, 82 are mounted on motor support plates 40, 41 extending beneath the lower support frame. Motor 82 includes a pressure released "fail safe" brake as in U.S. Pat. No. 4,655,633. When hydraulic fluid pressure from the vehicle hydraulic system is provided through appropriate hydraulic lines and a counterbalancing valve to motor 82, the brake is released allowing the drive shafts and universal joints 83, 84 to drive differentials within axles 50, 70 to propel the machine either in forward or reverse. Motors 81, 82 may be connected hydraulically in parallel or series to provide a selection of propulsion speeds.

As in U.S. Pat. No. 4,655,633, it is possible to substitute different propulsion structures on frame 12 including endless driven tracks of the type used on bulldozers, power shovels and other heavy construction machinery. However, rubber tired wheels, or solid steel disk wheels of a thinner variety than rubber tires, provide a narrower track to be filled in with concrete or other material being screeded when the apparatus is operated with the screed behind the rear wheels and driven through the poured, uncured concrete.

Figure 5:
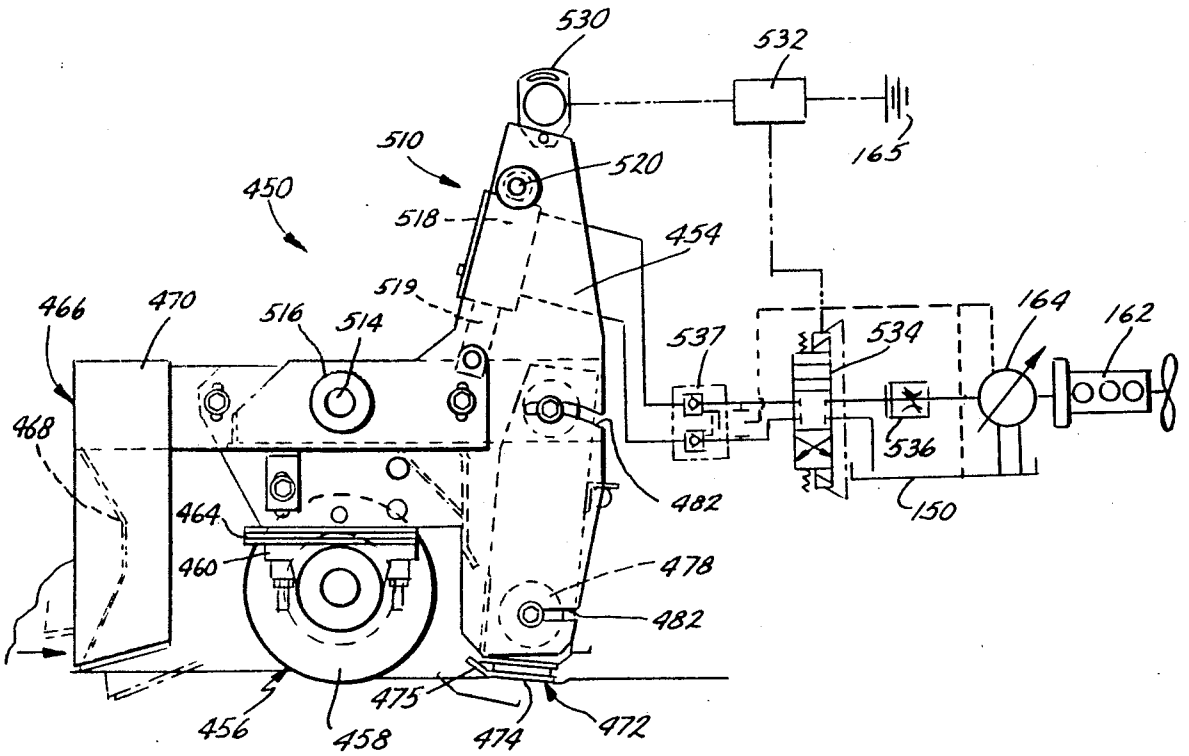
FIG. 5 is an end elevation of the screed assembly and a schematic diagram of the hydraulic system for operating the position control system of that assembly.

Referring now to FIGS. 1–3, the rotatable upper framework 90 includes a generally H-shaped support plate with a series of beams, vertical posts and stiffeners as in U.S. Pat. No. 4,655,633. Operator platform 112 includes an upstanding welded steel framework supporting engine fuel tank 150, hydraulic fluid tank 154, an engine accessory and hydraulic pump compartment 161 to the rear of tanks 150, 154, operator seat 156 in front of the tanks, tiltable control/steering console 158, and left and right control consoles 160*a*, 160*b* on either side of seat 156. A series of manually operated hydraulic control spool valves are mounted on the operator platform and controlled by individual control handles in consoles 160*a*, 160*b* as described in U.S. Pat. No. 4,655,633 for operating the various functions of the screeding machine 10. Laser beacon elevation control system panel 158*a* and engine control instrument panel 158*b* are mounted on console 158. Mounted within engine compartment 161 are a conventional internal combustion diesel or gasoline or electric engine 162, preferably larger than the engine included in the apparatus of U.S. Pat. No. 4,655,633, such as a Deutz F3L-912 fifty horsepower, three cylinder, diesel engine available from Deutz Engine Company of Koln, West Germany. Engine 162 includes exhaust muffler 163, air intake 167, and air cleaner 168 and provides power to a single, variable displacement, load sensing hydraulic pump 164 which draws and returns hydraulic fluid from tank or reservoir 154 as shown in FIG. 5. Engine compartment 161 also houses battery 165 for starting engine 162 and providing power for the various electrical controls, and various hydraulic system components including a hydraulic fluid filter 166 and the like. As explained below, the present apparatus avoids the need for spring retracted hydraulic hose reels previously used on the apparatus of U.S. Pat. No. 4,655,633 for playing out and withdrawing hydraulic fluid lines connected to the operating motors on the screeding assembly 450.

Preferably, variable displacement hydraulic pump 164 is of the type sold by Sunstrand under Model No. L-38-RBS-X-FP-X-3-B-XXX or by Cessna under Model No. 70423-RBT. The hydraulic fluid circuit is a closed center, load sensing system with manually adjustable flow controls for all functions which require speed control. Variable displacement pump 164 provides a volume of hydraulic oil required for functions being used at a pressure approximately 200 to 400 psi above the pressure required by the function requiring the highest pressure. If no functions are being used, the pump will provide just enough flow to make up for internal pump leakage, valve leakage and load sense bleed-down leakage and to maintain a pressure of 200 to 400 psi. Apart from the specific screed assembly controls, telescoping boom controls, dual propulsion motors and single variable displacement pump operation as described herein, the hydraulic system and controls are substantially similar to those used in the apparatus of U.S. Pat. No. 4,655,633.

As shown in FIG. 2, the hydraulic system also includes a rotatable hydraulic swivel assembly 169 like that used in the apparatus of U.S. Pat. No. 4,655,633. Swivel assembly 169 is mounted to project downwardly from the lower frame and upwardly through the center of the rotational bearing assembly 130 to provide fluid communication between the rotating upper framework where the internal combustion engine 162 and hydraulic pump 164 are located and the lower framework 12 where numerous fluid motors or connections to fluid motors are located. Generally, swivel assembly 169 includes an inner cylindrical spool or sleeve rotatable with the upper framework and an outer sleeve surrounding the inner spool having multiple fluid ports which communicate with individual passageways bored through the inner spool from various inlet port locations on the inner spool.

Telescoping Boom Assembly And Boom Support

As is best seen in FIGS. 1–4 and 10–19, telescoping boom assembly 170 is mounted for horizontal extension and retraction on upper framework 90 below operator platform 112. The boom assembly includes a rectangular boom support structure 172 fixedly secured on the upper frame 90 below the operator's platform 112 and above the rotational bearing assembly 130. As shown in FIGS. 2, 3 and 11, support structure 172 includes horizontally extending top and bottom support plates 174, 176 between which are welded vertically extending, spaced plates forming sidewalls 178, 180. On the inside surface of sidewalls 178, 180 are support rails 182, 184 which support cam followers 230, 232 at the rear end of large boom section 220 as described below. Rails 182, 184 each include top and bottom elongated, hardened, track strips 186, 188 which engage and support the circumferential surfaces of cam followers 230, 232.

At the rear end of the boom support structure 172 is a boom cylinder anchor or mounting plate 190 (FIGS. 1, 2, 17 and 18) bolted to support blocks 191, 193 which in turn are welded to the inside surfaces of horizontal mounting plates 192, 194. At the forward end of boom support structure 172 are upper and lower support bearings or cam followers 196, 198 (FIGS. 1 and 3) which are mounted respectively on upwardly and downwardly extending arm portions of the sidewall plates 178, 180. Cam followers 196, 198 engage the upper and lower surfaces of large boom section 220 a described hereinafter to support that section as it is moved outwardly of the rectangular boom support structure 172 while support rails 182, 184 engage cam followers 230, 232 to support the rear end of the large boom section during such movement.

As shown in FIGS. 10–12, 14, 15, 17 and 18, the boom support structure 172 also supports the boom power cylinder ground rod assemblies 200, 202 which are bolted at their rear ends to the inside surface of end anchor or mounting plate 190 (FIGS. 12 and 17) and extend inwardly of the telescoping boom assembly to a position adjacent the forward end of the boom power cylinder 270 when retracted to provide support for that forward boom cylinder and anchor the cables for operating the second boom section. Each ground rod assembly 200, 202 includes a pair of vertically spaced tubes 204, 206 or 208, 210 welded to vertical plates 212, 214. At the outer end of ground rod assemblies 200, 202 is mounted a ground rod guide bearing plate 216 (FIGS. 10, 14 and 15) including a circular opening therethrough for slidably receiving the outer casing of the boom operating fluid cylinder 270 described more fully hereinafter. The cantilevered ground rod assemblies essentially form I-type beam supports for the boom cylinder and may be adjusted via the mounting bolts through mounting plate 190 to raise or lower the outer ends of the ground rods and guide bearing plate 216.

Large boom section 220 is telescopically inserted and nested within the interior of boom support structure 172 for extension and withdrawal on opposed pairs of rear and forward cam followers by means of boom operating fluid cylinder 270. Large boom section 220 is rectangular but slightly smaller than the interior dimensions of boom support structure 172 as shown in FIG. 11. Large boom section 220 includes generally horizontal top and bottom plates 222, 224 and spaced pairs of vertical plates 226, 228 forming sidewalls for section 220. At the rear end of boom section 220 are rotatably mounted, vertically spaced, opposed pairs of cam follower wheels or bearings 230, 232 which engage the supporting rails or tracks 186, 188 on the inside surfaces of sidewalls 178, 180 of the boom support structure 172. At the forward end of large boom section 220, spaced, opposed pairs of cam follower wheels 234, 236 mounted on spaced, extending support arms are positioned to support the movement of small boom section 250 into and out of the large boom section during extension and withdrawal. A lubricious, resinous plastic wear strip 238 is secured across the top of the forward end of the large boom section 220 (FIGS. 3 and 11) to slidably support the hydraulic hoses and electrical cables which extend from the rear of the boom sections to screed assembly 450 at the outer end of small boom section 250 and prevent excessive wear on such tubes and cables during operation of the telescoping boom assembly 170. As shown in FIGS. 3 and 11, the top and bottom plates 222, 224 of boom section 220 also support elongated track strips 235, 237 for engagement by cam followers 196 and 198 respectively during extension and withdrawal of the large boom section.

Figure 16:
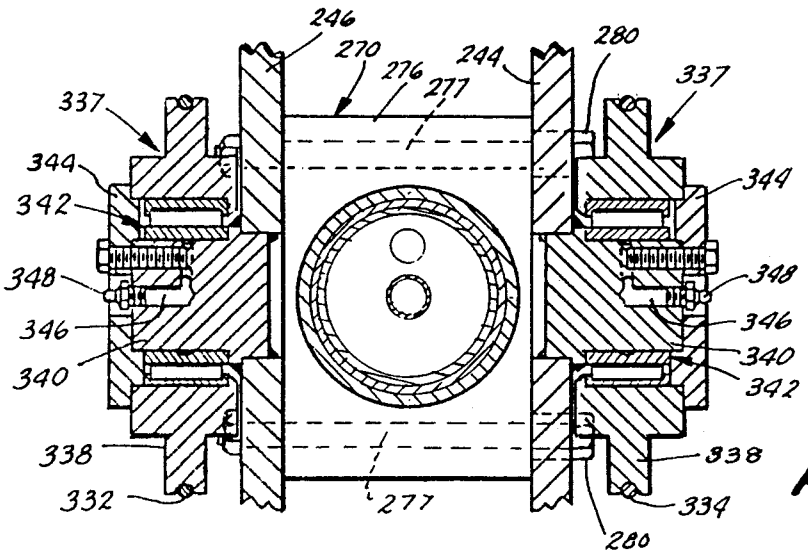
FIG. 16 is a sectional, end elevation of the boom operating fluid cylinder showing the pulley and cable mounting apparatus at the rear of the large boom section and taken along plane XVI—XVI of FIG. 1.
Figure 17:
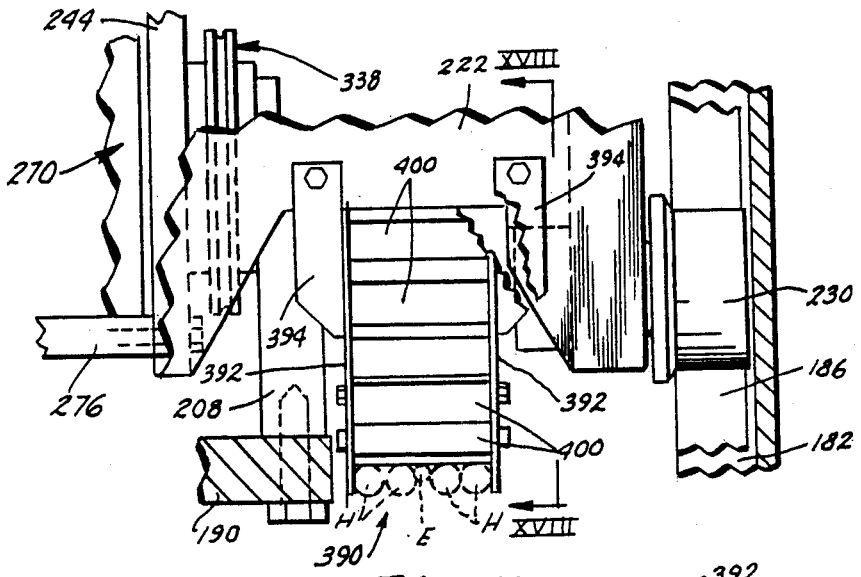
FIG. 17 is a fragmentary, sectional plan view of the rear portion of the boom assembly illustrating the hydraulic hose and electric cable roller support assembly.
Figure 19:
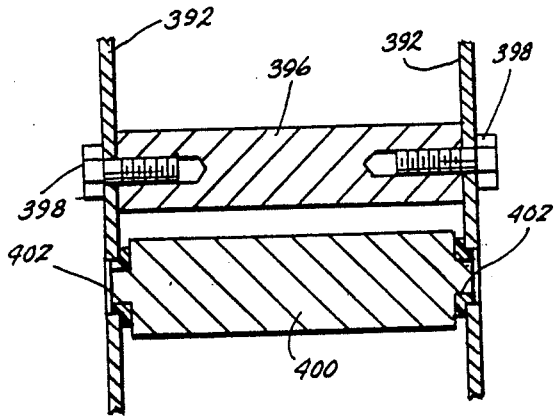
FIG. 19 is a sectional view of one of the support rollers in the assembly of FIGS. 17 and 18 taken along plane XIX—XIX of FIG. 18.
Figure 18:
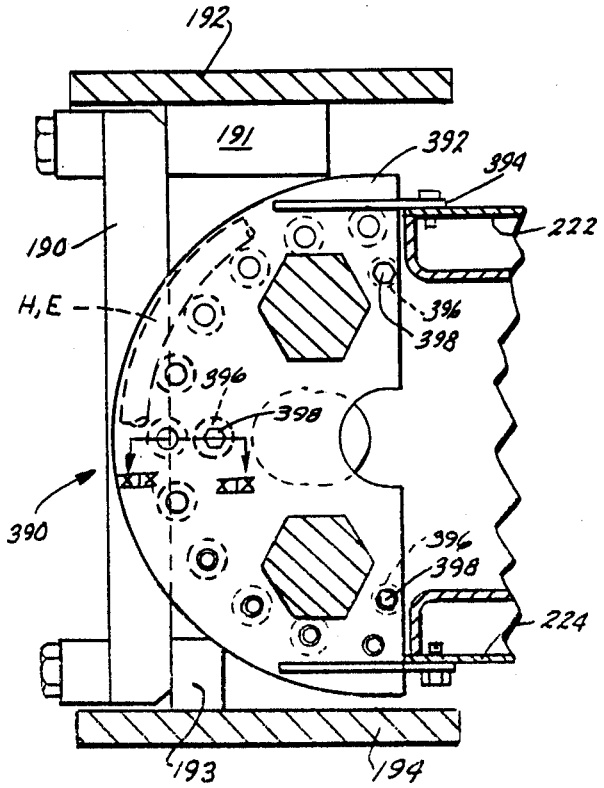
FIG. 18 is a sectional, side elevation of the assembly of FIG. 17 taken along plane XVIII—XVIII of FIG. 17.

As will be understood from FIGS. 10, 12 and 16, large boom section 220 includes boom cylinder mounting plates 244, 246 welded in place between top and bottom plates 222, 224 which are parallel to but spaced from one another at the rear end of large boom section 220 and between which is secured the boom operating fluid cylinder 270 described hereinafter in connection with FIGS. 10 and 13. Boom cylinder assembly 270 includes a pair of spaced vertically extending mounting plates 276, 278 which extend perpendicular to cylinder mounting plates 244, 246 and include through bores 277, 279 for receiving fluid cylinder mounting bolts 280 (FIGS. 13 and 16). Accordingly, boom operating fluid cylinder 270 is supported generally perpendicular to end anchor mounting plate 190 and generally parallel to mounting plates 244, 246.

On the inside surfaces of sidewalls 226, 228 of large boom section 220 are supported parallel small boom section support channels 240, 242 each of which has a pair of spaced hardened track strips 265, 267 secured therealong for engaging cam followers 264, 266 on the small boom section in a fashion similar to that for support rails 182, 184 and track strips 186, 188. Rails 240, 242 are centrally positioned on the sidewalls and may comprise steel channel secured with its side flanges providing the upper and lower support rails.

As is also shown in FIGS. 1–3 and 11, small boom section 250 is rectangular and slightly smaller than the interior dimensions of large boom section 220. Small boom section 250 telescopes and is nested within large boom section 220 and includes screed assembly mounting unit 410 on its forward, free end as shown in FIGS. 1–4. As is best seen in FIG. 11, small boom section 250 includes horizontal top and bottom plates 252, 254 and spaced pairs of vertically oriented side plates forming sidewalls 256, 258. At the corners on the top and bottom plates 252, 254 are mounted elongated track strips 260, 262 for engaging the upper and lower cam followers 234, 236 at the forward end of large boom section 220 during extension and withdrawal. At the rear end of small boom section 250 are mounted vertically aligned, opposing pairs of cam follower wheels or bearings 264, 266 which engage the upper and lower surfaces of track strips 265, 267 on channels 240, 242, respectively, to position and support the small boom section within the large boom section. Also included on the inside surface of bottom wall 254 of small boom section 250 are a pair of spaced cable clamping blocks 268 (FIGS. 10 and 11) which secure the small boom section 250 to pulley and cable assembly 330 for extension and withdrawal of the small boom section during movement of the large boom section by boom fluid cylinder 270 as explained hereinafter.

Referring now to FIGS. 10, 12, 13 and 16, boom operating fluid cylinder 270 includes an outer tubular assembly 272 which is secured to and movable with large boom section 220 by means of cylinder mounting plates 276, 278 and an inner boom cylinder rod assembly 274 which is fixedly mounted to anchor/mounting plate 190 on upper frame 90 by extending rod end 275. When hydraulic fluid is inserted under pressure through port 276, internal conduit 277, central tubular conduit 278 and port 279 into the variable volume chamber between the end of rod 274 and the interior end of outer tubular assembly 272, the tubular assembly 272, and thus large boom section 250, are forced outwardly. Such outward movement simultaneously moves the small boom section 250 outwardly by means of the pulley and cable assembly 330 as explained below. Simultaneously, the hydraulic hoses and electrical cables E and H (FIGS. 10 and 17) are pulled outwardly with the extended small boom section 250. Upon withdrawal of fluid from the end of rod assembly 274 and insertion of hydraulic fluid through port 280, internal conduit 281 and tubular passageway 282 which concentrically surrounds central tube 278 such that fluid is injected through port 284 on the interior side of outer rod end 288, the outer tubular assembly 272, and thus large boom section 220 and small boom section 250, are withdrawn into boom support structure 172 with a resultant withdrawal of hoses H and cables E.

As is best seen in FIG. 13, outer tubular assembly 272 includes a rear tube 290 welded to an extending tube 292 which is telescoped therewithin and lined with a stop tube 294. Abutting the rear end surfaces of tube 292 and liner tube 294 is a seal tube 296 carrying a plurality of bearings 297, as well as seals 298 and rod wiper 299 which engage and move along the outer surface of boom cylinder rod assembly 274 when the large boom section is extended or withdrawn. An O-ring with backup ring 300 is also included on the exterior surface of seal tube 296 to prevent leakage of hydraulic fluid out of the cylinder between outer tube 290 and seal tube 296. The outer end of forward tube 292 is closed by a cylindrical plug 302 welded therein. Plug 302 has blind bores 304, 306 for receiving guide pins and an adjustment bolt for the pulley and cable take-up assembly 330 to be described hereinafter.

As is also shown in FIG. 13, the interior fixed boom cylinder rod assembly 274 includes a cylindrical tube 308 mounted adjacent the exterior circumference of a cylindrical plug 310 from which rod end 275 extends rearwardly at the rear end of the cylinder. Cylindrical plug 310 includes bores 277, 281 forming internal conduits leading from ports 276, 280 to and from ports 279, 284 described above. Central tube 278 is mounted concentric within tube 308 between cylindrical plug 310 and a forward cylindrical member 312 at the forward end of tube 278. Cylindrical member 312 carries a cylindrical seal mounting member 314 including a plurality of bearings 316 and seals 318, 320. Seal carrying cylinder 314 is telescoped over an outer reduced diameter portion 313 of cylindrical member 312 and is retained thereon by nut 322 secured over the forward, threaded end of the reduced diameter portion 313 of cylindrical member 312. Central tube 278 thus carries hydraulic fluid forwardly through cylindrical member 312 to act against outer tubular assembly 272 and the inside surface of cylindrical member 302 at the forward end of the fluid cylinder.

Figure 12:
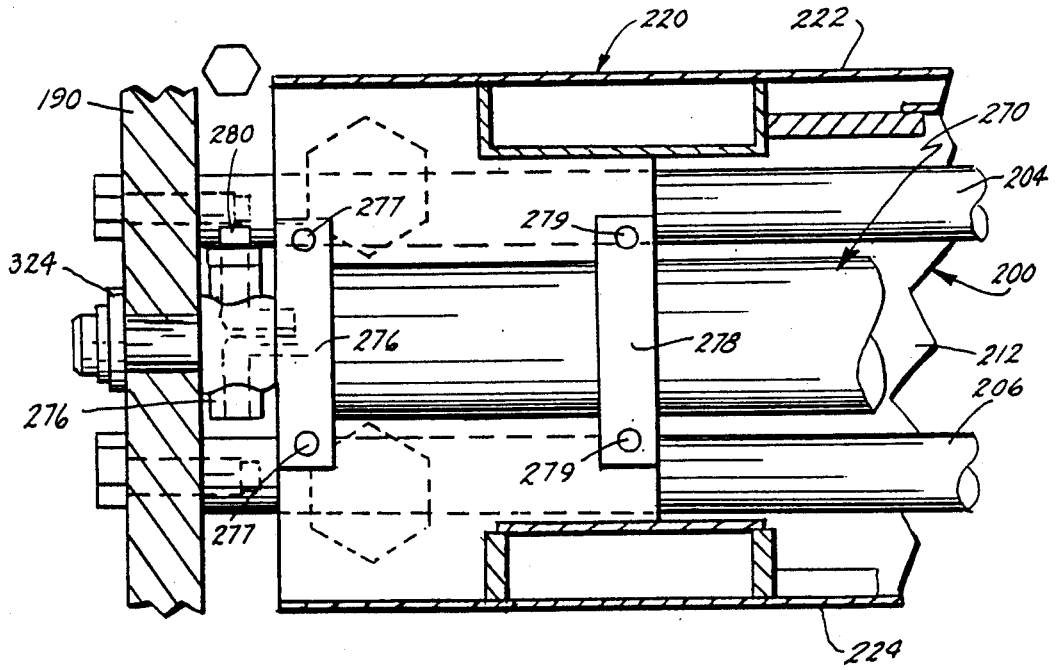
FIG. 12 is a sectional side elevation at the rear of the telescoping boom assembly taken along plane XII—XII of FIG. 2.
Figure 13:
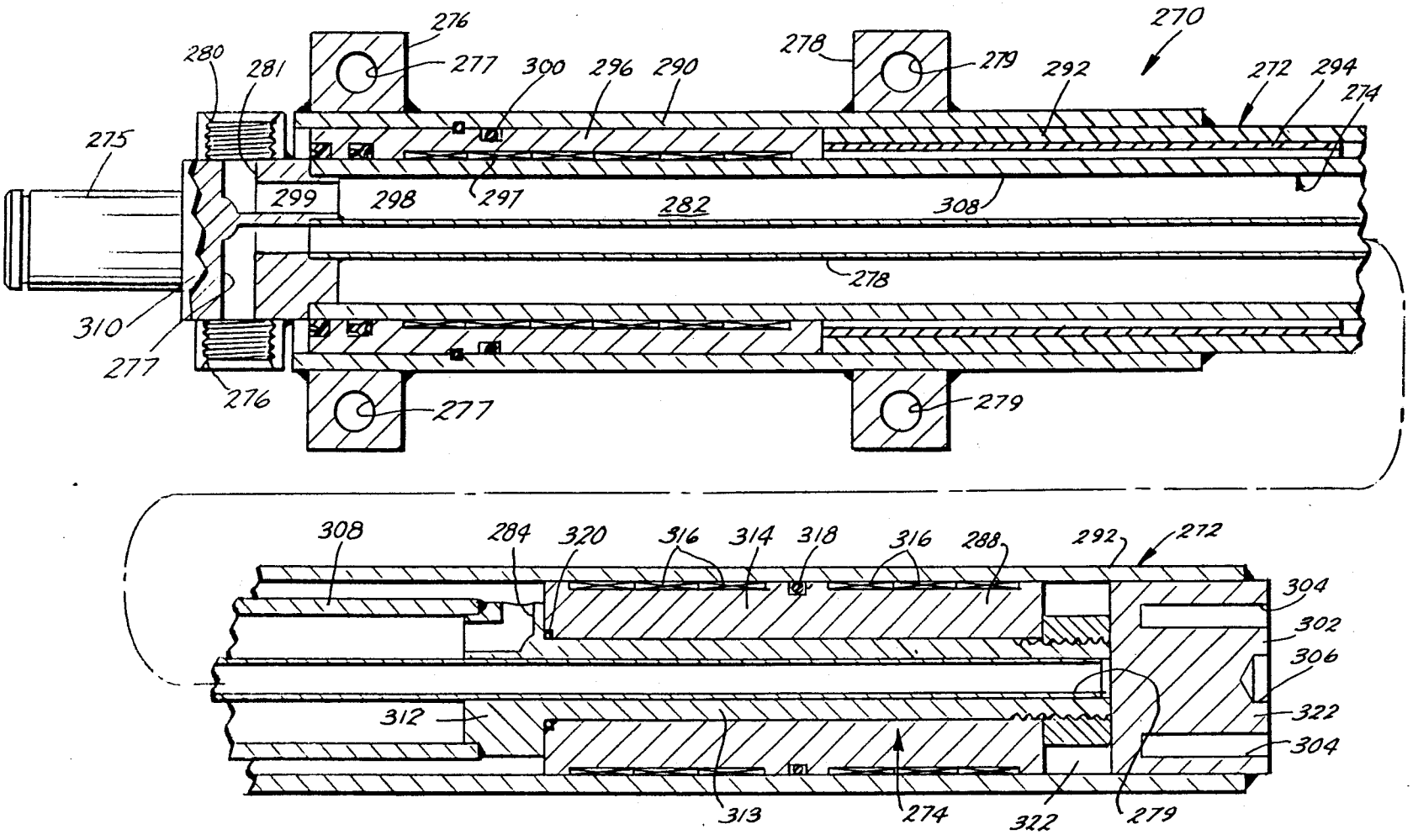
FIG. 13 is a sectional side elevation of the boom operating fluid cylinder shown in compressed state.

As shown in FIG. 12, the rear end 275 of rod assembly 274 is secured through end anchor/mounting plate 190 by means of a securing ring and thrust washer 324. Ring 324 holds the fluid cylinder stationary with respect to mounting plate 190 and upper frame 90 and allows ports 276, 280 to be connected to the hydraulic fluid line as shown schematically in FIG. 10. As shown in FIG. 10, hydraulic fluid under pressure is admitted through a manually adjustable fluid control valve 326 and a detented spool valve 328 to extend or retract the outer tubular assembly 272, and thus large and small boom sections 220, 250, by advancing or retracting the spool valve handle 329. Fluid spool valve 328 is of the type sold under Model No. V20 by Gresen Manufacturing Company of Minneapolis, Minn.

Figure 14:
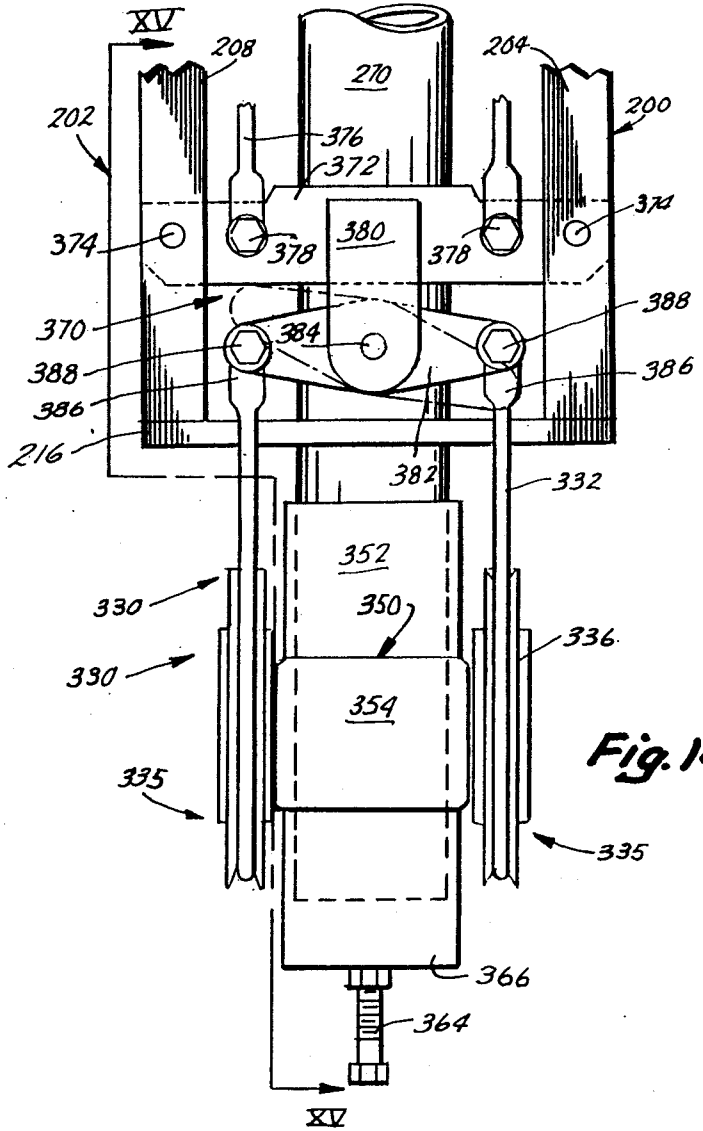
FIG. 14 is a plan view of the outer end of the boom operating fluid cylinder illustrating the cable and pulley assembly for operating the secondary boom section.
Figure 15:
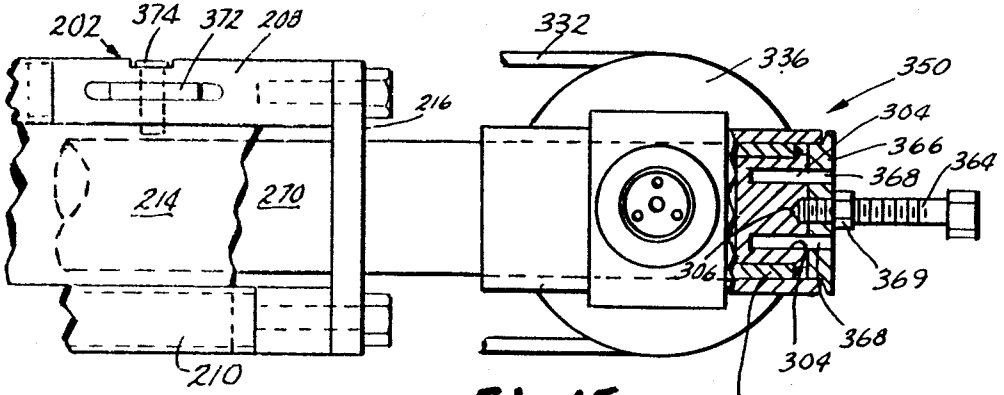

Referring now to FIGS. 10, 11 and 14–16, pulley and cable assembly 330 is connected between the large and small boom sections 220, 250 to extend and retract the small boom section simultaneously with movement of the large boom section but at an increased rate as described below. Pulley and cable assembly 330 includes a pair of cables 332, 334 connected via cable attachment assembly 370 to ground rods 200, 202 as shown in FIGS. 14 and 15. Cables 332, 334 are supported on aligned pairs of sheaves or pulleys 336, 338, respectively at the forward and rearward ends of the boom operating fluid cylinder 270.

As shown in FIG. 16, base pulley assemblies 337 including laterally spaced pulleys 338 are included on the outer sides of mounting plates 244, 246. Each base pulley assembly 337 includes an outwardly extending cylindrical stud or pin 340 having a roller bearing assembly 342 telescoped over a reduced diameter portion of the stud. Pulley 338 is rotatably mounted on roller bearing assembly 342 with respect to support stud or pin 340 and includes a semi-circular notch or groove in its outer circumference for receiving and retaining cables 332, 334. An end cap 344 is bolted to the outer surface of pin 340 to retain the pulley 338 in place. Stud or pin 340 also includes a grease passageway 346 and Zirc fitting 348 for lubrication of the roller bearing assembly 342. Accordingly, pulley assemblies 337 are centrally located on mounting plates 244, 246 for rotatably mounting cables 332, 334 on the rear end of large boom section 320.

At the forward end of boom operating cylinder 270 is mounted a second set of laterally spaced pulley assemblies 335 on a cable take-up assembly 350. As is best seen in FIGS. 11, 14 and 15, cable take-up assembly 350 includes a cylindrical tube 352 slidably mounted in telescoping fashion over the end of outer fluid cylinder tube assembly 272 at the forward end of the fluid cylinder 270. A trunion 354 is secured to the outer surface of tube 352 and includes laterally extending cylinders or pins 356 (FIG. 11) having reduced diameter portions receiving roller bearing assemblies 358. Pulleys 336 are mounted on the roller bearing assemblies 358 with an end cap 362 bolted to the end surface of pin or cylinder 356. Pulleys 336 include outer circumferential grooves or notches receiving the cables 332, 334.

In order to adjust the position of cable take-up assembly 350 axially with respect to fluid cylinder 270, an adjustment bolt 364 is threaded centrally through a cylindrical end cap 366 secured at the forward end of take-up tube 352. Guide pins 368 are received through end cap 366 in blind bores 304 in cylinder end 322 as described above. A locking nut 369 is provided on bolt 364 to secure the bolt in a desired adjusted position. Hence, clockwise rotation of bolt 364 will advance the bolt against blind bore 306 and draw cable take-up assembly 350 outwardly with respect to the end of fluid cylinder 270. Simultaneously, pulleys 336 will be drawn outwardly to stretch and tighten cables 332, 334. Bolt 369 is tightened against end cap 366 to secure the take-up assembly in its adjusted position. Movement of the take-up assembly is guided by cylinder 352 on the outer surface of cylindrical assembly 272 and by guide pins 368 in bores 304.

As shown in FIGS. 14 and 15, cables 332, 334 are secured to the ground rods 200, 202 by a cable attachment assembly 370. Attachment assembly 370 includes a cable anchor link 372 extending laterally across fluid cylinder 270 between ground rod tubes 204, 208 to which it is fixedly secured by pins 374. Cable attachments 376 at one end of each of cables 332, 334 are securely bolted to extend toward the rear of the boom assembly from anchor link 372 by pins 378. Extending forwardly from anchor link 372 are a vertically spaced pair of connecting links 380 welded to the top and bottom surfaces of anchor link 372. A cable anchor balancing swivel plate 382 is pivotally mounted between connecting links 380 by pin 384 such that it may rotate with respect to anchor link 372. Cable attachments 386 secured to the opposite ends of cables 332, 334 from cable attachment 386 are pinned to the opposite ends of balancing plate 382. Accordingly, pivotal movement of swivel plate 382 allows balancing of the loads imposed on cables 332, 334 during movement of the large and small boom sections.

As will now be understood, outward movement of fluid cylinder assembly 272 by hydraulic pressure causes outward extension of large boom section 220. Simultaneously, pulley and cable assembly 330 is carried outwardly with fluid cylinder 270 and large boo section 220. Since cables 332, 334 are connected to the interior of small boom section 250 via connecting blocks 268, outward movement of pulley and cable assembly 330 simultaneously extends small boom section 250 but at a rate twice as fast as the movement of large boom section 220. Such increased rate results from the mechanical advantage provided by cables 332, 334 extending around pulleys 336, 338.

With reference to FIGS. 2, 10 and 17–19, a hydraulic hose and electric cable support assembly 390 is provided at the rear end of large boom section 220. Hose and cable support assembly 390 includes a guide roller assembly having a pair of semi-circular guide roller mounting plates 392 spaced laterally from one another and bolted to top and bottom plates 222, 224 of large boom section 220 via flanges 394. Extending laterally between plates 392 are three rigid spacer members 396 (FIGS. 18 and 19) secured in place by bolts 398. Extending in a semi-circular arrangement spaced inwardly from the semi-circular edges of guide plates 392 are eleven guide rollers 400 rotatably mounted on lubricious bronze bushings 402 inserted in circular apertures bored through the guide plates. Accordingly, hydraulic hoses H and electrical cables E leading from the lower portion of upper frame assembly 90 extend around the series of guide rollers 400 from the bottom of hose and cable support assembly 390 to the top and extend forwardly to the outer free end of small boom section 250. During extension and retraction of the telescoping boom assembly 170, hoses H and cables E, which are of a fixed length, roll over the rotatable guide rollers 400 as large boom section 220 moves forwardly or rearwardly to prevent binding and chafing of the hoses and cables during such movement. Typically, hydraulic hoses for the screed elevation tubes, vibration motor and auger motor forming a part of the screed assembly 450 mounted at the outer end of small boom section 250 are carried on assembly 390 along with an electrical cable from the laser receivers which leads to a control unit in the operator platform.

Screed Assembly And Screed Elevation Assembly And Control System

Figure 4:
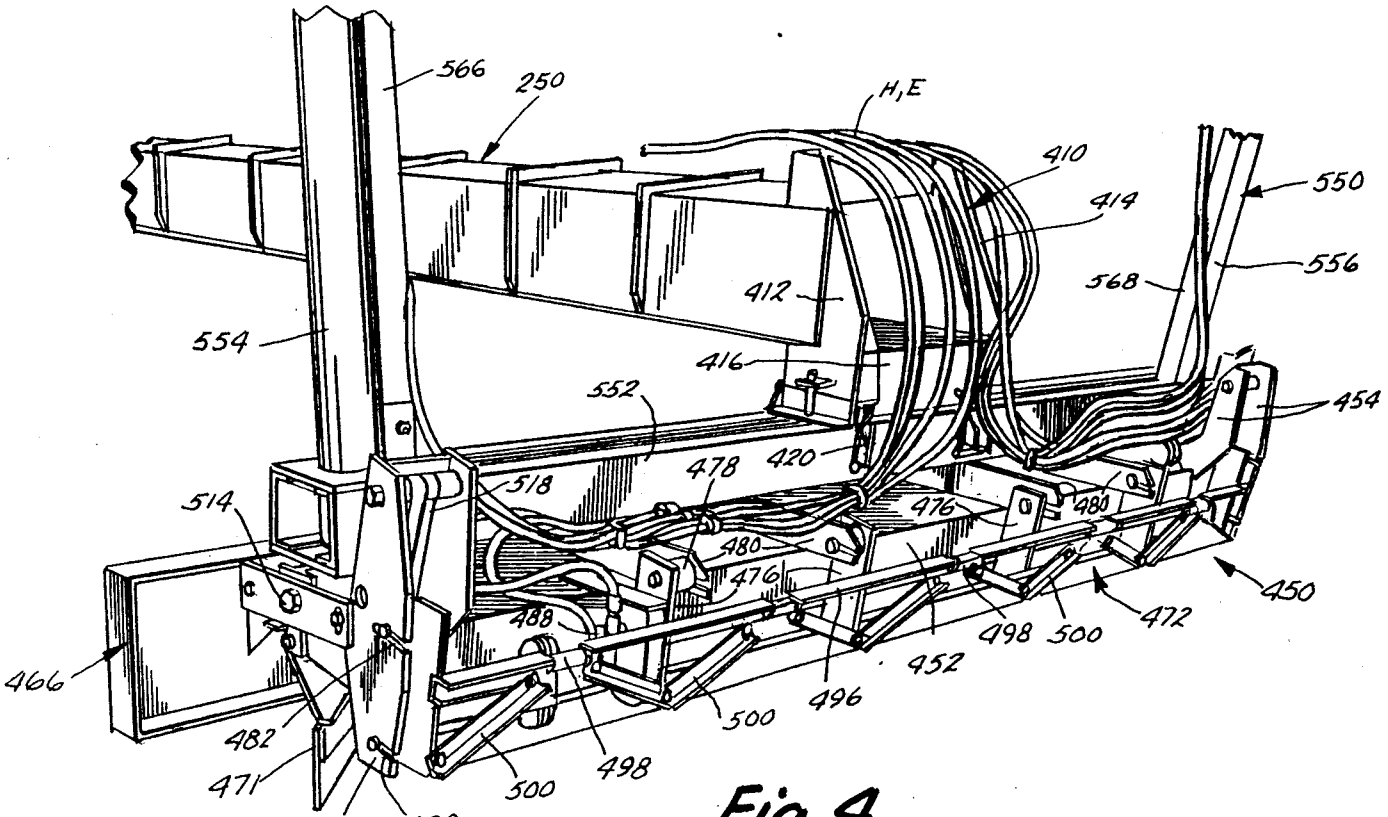
FIG. 4 is a perspective view of the telescoping boom and screed assembly of the apparatus of FIGS. 1–3.

Referring now to FIGS. 1–4 and 5–9, screed assembly 450 is mounted on boom mount assembly 410 such that it may be moved toward and away from the upper frame 90 and lower support frame 12 on telescoping boom assembly 170 by means of boom operating fluid cylinder 270 and pulley and cable assembly 330. As is best seen in FIGS. 1 and 4, boom mount assembly 410 includes a pair of generally triangularly-shaped plates 412, 414 welded or otherwise rigidly secured to the outer end of small boom section 250 such that they project below the bottom wall 254 of the small boom section 250 and define an opening into the hollow interior of the boom sections. A front plate 416 and a rear plate 418 (FIG. 1) provide support for a series of four overcenter-type bolts or latches 420 which engage flanges secured to the front and rear of the screed elevation beam 552 to hold the entire screed assembly 450 on the underside of boom mount 410.

Screed assembly 450 is an improved version of the screed assembly of U.S. Pat. No. 4,655,633 and includes a plow or striker 466 positioned in front of rotational auger 456 and a vibrationally isolated vibratory screed 472 positioned behind rotational auger 456 with respect to the direction of movement of the screed on boom assembly 170. In addition, screed assembly 450 includes an additional pivot axis 514 and an electro-hydraulic level sensing unit 530 and associated control 532 for automatically counteracting the force of concrete or other material to be screeded which acts against the plow 466 and which would otherwise change the position of the plow and vibratory screed and prevent effective screeding.

Screed assembly 450 includes an elongated horizontally extending screed support beam 452 (FIG. 4) including a pair of spaced vertically extending end plates 454 at either end of the beam (FIG. 5). Centrally located beneath the support beam 452 is a rotational auger assembly 456 including a continuous auger 458, preferably about twelve feet in length in the preferred embodiment, rotationally mounted generally parallel to beam 452 on a pair of spaced, bearing pillow blocks 460, one at either end of the support beam 452. Pillow blocks 460 are bolted to a bearing support on the underside of support beam 452 adjacent end plate 454. A series of shim plates 464 may be included between the pillow blocks 460 and beam 452 to adjust the relative position of the auger 458 for wear which occurs throughout the life of the machine. Auger assembly 456 is preferably rotated by a single hydraulic motor 463 located at one end of the screed assembly such as the left end as shown in FIGS. 2 and 3. This causes concrete to be moved left or right along the axis of the auger blade 458 in a lateral direction generally perpendicular to the direction in which screed assembly 450 is moved by boom 170.

Spaced forwardly of the rotational auger assembly 456 at the front edge of support beam 452 is an elongated plow 466 having a concave mold board 468 and end plates 470. Plow 466 is secured rigidly to the front edge of beam 452 such that it establishes the initial rough grade or concrete height by removing excess concrete in front of the auger assembly 456 while allowing a predetermined portion of the concrete to pass therebeneath. As auger 458 is rotated it carries concrete toward one end of screed assembly 450. End plow 471 (FIGS. 3 and 4) is preferably mounted at the downstream end of auger 458 toward which the concrete is carried to deflect concrete away from the same end of vibratory screed 472 thereby preventing any buildup of concrete at that end.

Figures 8, 9, 10:
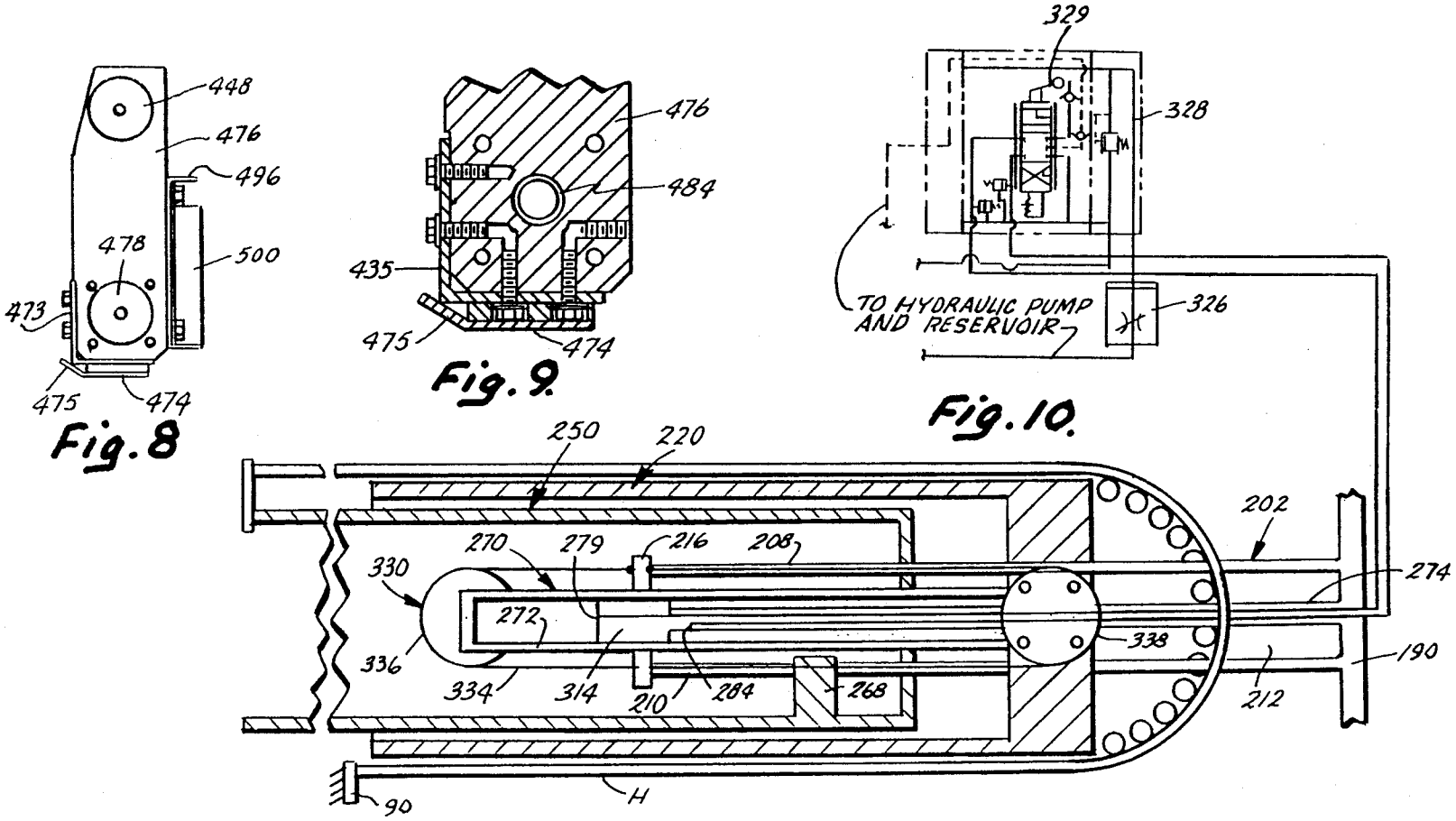
FIG. 8 is an end elevation of the vibratory screed assembly shown in FIG. 7.
FIG. 9 is a fragmentary, sectional end elevation of the vibratory screed assembly taken along plane IX—IX of FIG. 7.
FIG. 10 is a schematic illustration of the telescoping boom assembly of the present invention including the hydraulic control system for extending and retracting the boom assembly.
Figure 11:
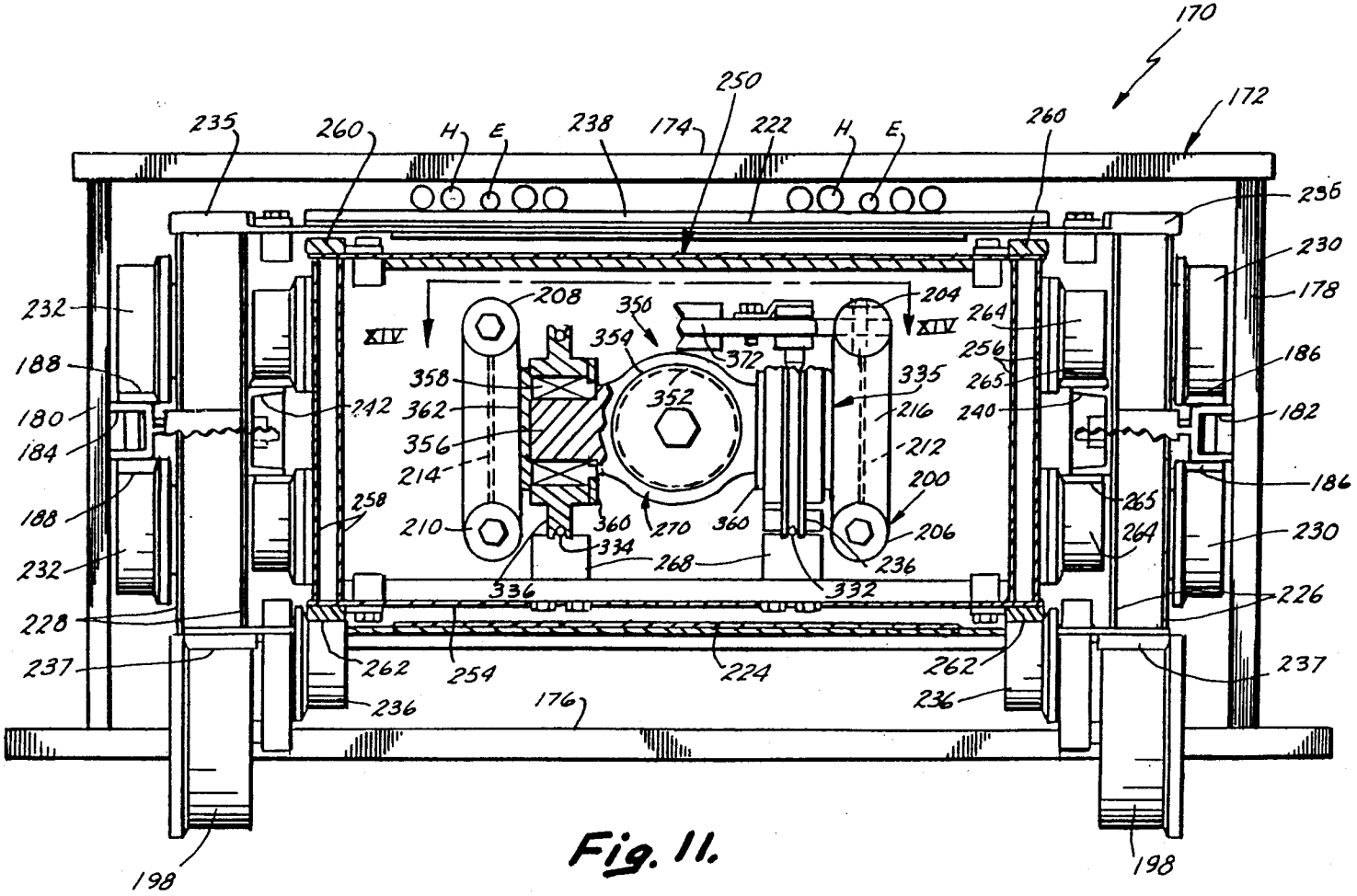
FIG. 11 is a sectional end elevation of the telescoping boom assembly taken along plane XI—XI of FIG. 1.

At the rear of the screed assembly 450 is a vibrationally isolated vibratory screed 472 best seen in FIGS. 4, 5 and 7–9. Vibratory screed 472 includes an elongated generally horizontally extending screed plate or strip 474 bolted to the underside of angle member 473 which, in turn, is bolted to the front edges of a series of vertically extending mounting plates 476 (FIGS. 8 and 9). Strip 474 has an upwardly angled lip 475 on its front edge. At the ends of the vibratory screed, mounting plates 476 each include outwardly extending, vertically spaced rubber mounts 478 secured by bolts extending through plates 476. The four mounting plates 476 intermediate the ends include single rubber mounts 478 secured by bolts 479 extending through those plates. Bolts 479 are secured to rearwardly extending support plates 480 welded to the top surface of support beam 452 (FIG. 4) or bolted between the end plates 454 in slots 482. By loosening bolts 479 and changing the position of the vibratory screed 472 in slots 482, the angle of the vibratory screed with respect to the vertical may be adjusted as desired.

Vibration for the screed 472 is provided by a rotatable shaft 484 extending through a series of six bearings 486 bolted to the six vertically extending mounting plates 476. A single hydraulic rotation motor 488 rotates a pulley and belt drive 490 imparting rotation in either the clockwise or counterclockwise direction for shaft 484. A series of six weights 492 are bolted to shaft 484 eccentrically with respect to the shaft axis and immediately adjacent bearings 486 by U-bolts to cause vibration of assembly 472 when hydraulic motor 488 is operated to rotate drive 490 and shaft 484. Operation of the vibratory screed while the screed assembly is passing over the uncured concrete causes the concrete to be smoothed and compacted with the fluid in the concrete brought to the surface to enhance smoothing. However, vibration is isolated from the remainder of the screed assembly by rubber mounts 478 to enable effective operation of striker plow 466 and auger 456.

Because of the length of the screed strip 474 across the bottom of the vibratory screed 472, a screed deflection assembly 494 (FIG. 7) is provided for adjusting the shape of the screed strip. Deflection assembly 494 includes a horizontally extending angle member 496 which is bolted to the trailing edges of vertically extending mounting plates 476. Between each of the mounting plates is a turnbuckle assembly 498 which allows adjustment in the length of the angle member 496. At the same time, deflection angle members 500, which are bolted between the lower trailing edges of mounting plates 476 and mounting plates 502 connected to and immediately adjacent turnbuckle assemblies 498, may be adjusted to move mounting plates 476 and, thus, raise or lower and deflect the screed strip 474 adjacent each mounting plate 476. Accordingly, such adjustment using turnbuckle assemblies 498 allows screed strip 474 to be trued to avoid sags or curves along its horizontal length.

Figure 7:
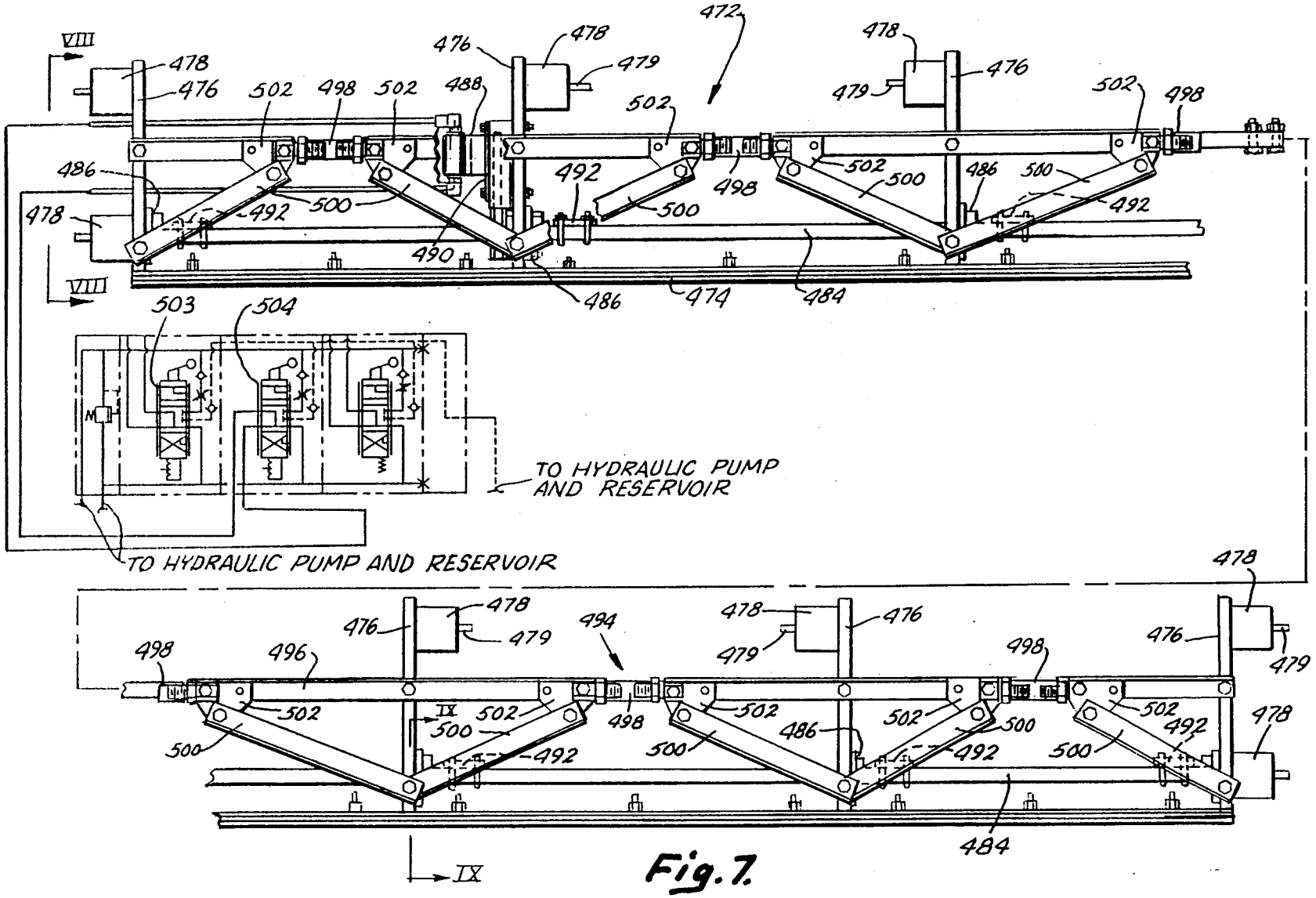
FIG. 7 is a side elevation of the vibratory screed assembly of the present invention including a schematic diagram of the hydraulic valve control system for operating that assembly.

As is also shown in FIG. 7, hydraulic control of auger assembly 456 by the vehicle operator is provided through a detented, manually operable valve 503 adjacent the operator position. Valve 503 is part of a three valve bank adjacent operator seat 156 which also includes valve 504 for controlling hydraulic motor 488 for shaft 484. Valve 504 allows hydraulic fluid to be directed through the hydraulic motor 488 to rotate a drive assembly 490, and thus the eccentric vibratory shaft 484, in either the clockwise or counterclockwise direction as desired.

Alternately, a modified embodiment 600 of the vibratory screed shown in FIGS. 20–23 may be used with screed assembly 450. Vibratory screed 600 is stiffer and less flexible over its entire horizontal length than is vibratory screed 472 and is simpler in design. Screed 60 includes a pair of elongated, continuous, one piece cylindrical tubular beams 602, 604 each having end caps 606, 608 at opposite ends closing the tubes. At the ends of each tube are cylindrical rubber mounts 610 secured in place by bolts 612 threaded into end caps 606, 608. Bolts 612 are received in slots 482 in end plates 454 at either end of the screed assembly. By tightening or loosening nuts on bolts 612, the angle of vibratory screed 600 can be changed with respect to the vertical in the same manner as for vibratory screed 472.

Figures 20, 21, 22, 23:
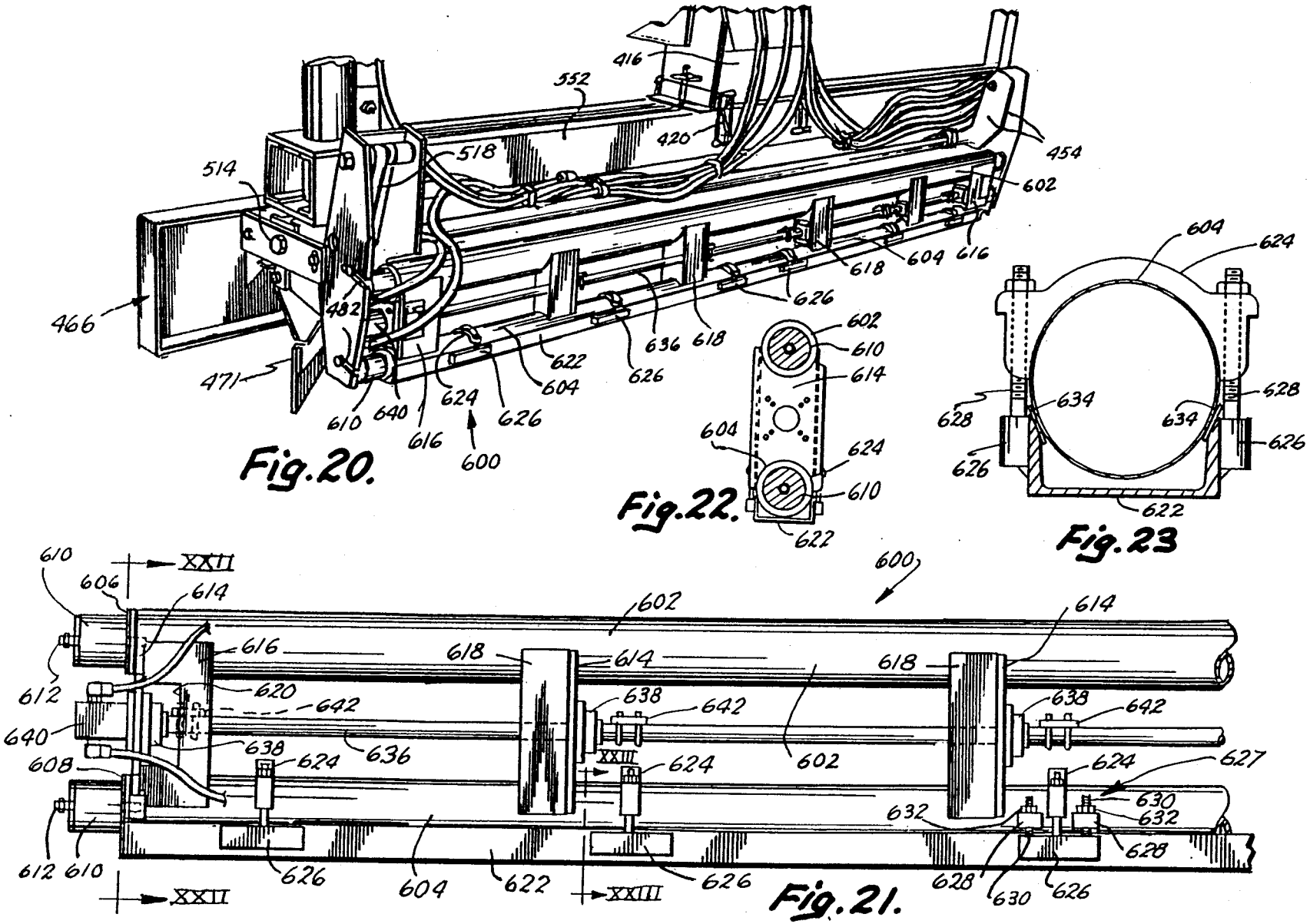
FIG. 20 is a perspective view of a modified screed head including an alternative vibratory screed useful with the screeding apparatus of the present invention.
FIG. 21 is a fragmentary elevation of the left one-half of the vibratory screed of FIG. 20, the right one-half being a mirror image except that there is no hydraulic motor in the right one-half of the screed.
FIG. 22 is a sectional end view of the vibratory screed taken along plane XXII—XXII of FIG. 21.
FIG. 23 is a sectional end view of the lower tubular member and screed strip of the vibratory screed taken along plane XXIII—XXIII of FIG. 21.

Tubular members 602, 604 are secured in their vertically spaced positions by six spacer plates 614 welded at spaced intervals along the length of the tubes. Each spacer plate 614 includes semi-circular recesses in its end surfaces for receiving the contoured surfaces of tubes 602, 604 as shown in FIG. 22. Bracing plates or gussets 616, 618 are welded on either side of the tubes adjacent plates 614. End gussets 616 each include a rectangular recess 620 providing access to the shaft support bearing 638 at each end of the vibratory screed. Thus, lower tubular member 604 is rigidly supported throughout its length by spacer plates 614 and gussets 616, 618 such that it is held substantially rectilinear along its entire length.

Along the lower side of tubular member 604 is a channel member 622 providing a concrete engaging screed strip which extends continuously from one end of the screed 600 to the other. As is best seen in FIGS. 21 and 23, screed channel 622 is secured to tube 604 by means of six semi-circular hanger brackets 624 positioned in a saddle-like manner over the top of tube 604. Each bracket 624 is aligned with a pair of mounting blocks 626 one on either side of the channel 622 at each hanger bracket position. Threaded rods 628 extend from each side of the hanger brackets into mounting blocks 626 and are secured by nuts to hold the channel tightly against the underside of tube 604.

Although screed 600 is stiffer than screed 472, one or more deflection/adjusting assemblies 627 are provided for adjusting the position of screed channel 626 at various locations along its length such that the overall shape of channel 622 may be trued to avoid sags or curves along its length. Deflection/adjusting assemblies 627 include blocks 628 welded to the sides of tubular member 604 adjacent on or more of the hanger brackets 624 (FIG. 21). Threaded rods are screwed through blocks 628 to bear against the top surfaces of mounting blocks 626. The threaded rods are held in position by jam nuts 632. Thus, by tightening or loosening rods 630, channel 622 may be pushed up or down and, thus, deflected at desired positions for trueing purposes. Although only one deflection assembly 627 is shown in FIG. 21, additional ones may be included along the length of screed channel 622 at each position of brackets 624.

Alternately, trueing the shape of channel 622 may be accomplished by using shims 634 (FIG. 23) instead of the deflecting assemblies 627 described above. Shim 634 may be placed between the upper edges of the vertically extending side portions of channel 622 at one or more of the hanger bracket positions in order to modify and true the shape of channel 622 along its length.

As is best seen in FIG. 21, vibration for screed 600 is provided by a rotatable shaft 636 mounted in a series of bearing pillow blocks 638, one bearing block on each of the six support plates 614 along the length of the screed. Shaft 636 extends through one end support plate 614 to a hydraulic motor 640 which rotates shaft 636 in either clockwise or counterclockwise direction as determined by hydraulic fluid directed to the motor through appropriate hydraulic lines just as in vibratory screed 472. However, screed 600 does not require any pulley and belt drive as in screed 472. A series of weights 642 are bolted to shaft 636 eccentrically with respect to the shaft axis and immediately adjacent bearings 638 by U bolts to cause vibration of assembly 600 when hydraulic motor 640 is operated to rotate shaft 636. Yet, because screed 600 is mounted on screed assembly 450 with rubber mounts 610, vibration of screed 600 is isolated from the remainder of the screed head.

Figure 6:
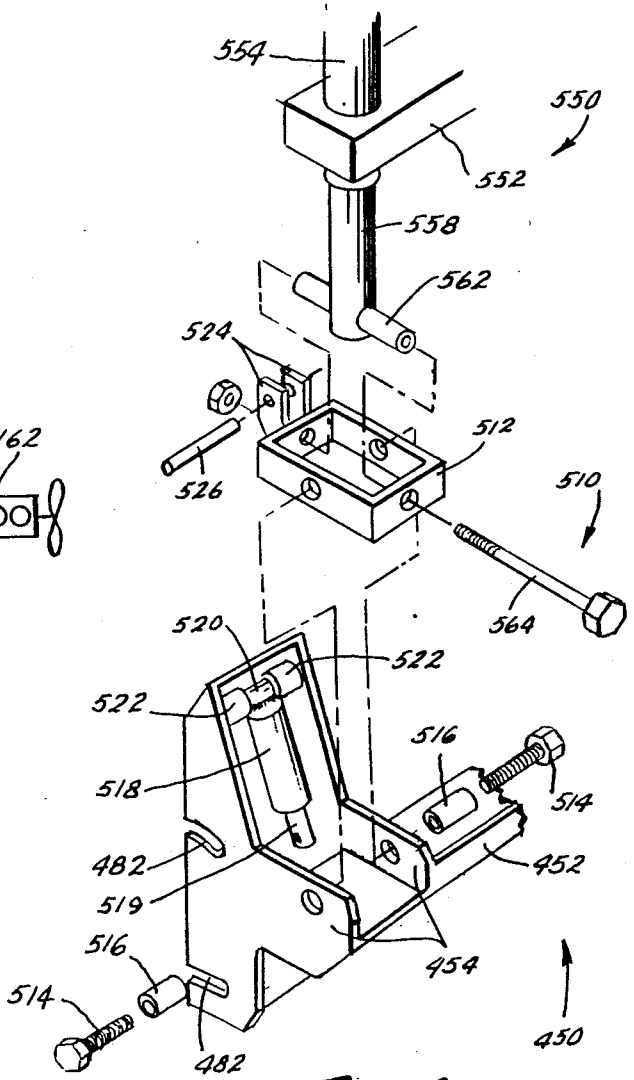
FIG. 6 is an exploded, perspective, fragmentary view of one end of the screed assembly illustrating the pivot yoke having orthogonal pivot axes for the screed assembly.

As best seen in FIGS. 4, 5 and 6, screed assembly 450 is preferably pivotally mounted about a pair of orthogonal pivot axes at each end of the screed assembly with respect to the screed elevation beam 552 by means of an electro-hydraulic leveling assembly 510. Assembly 510 includes a rectangular pivot yoke 512 fitted between laterally spaced portions of end plates 454 and secured for pivotal movement in a vertical plane on a generally horizontal axis extending parallel to the direction of elongation of the screed assembly by means of securing bolts 514 and bushings 516 passing through plates 454 and pivot yoke 512. A hydraulic fluid cylinder 518 is pivotally secured to the upright end plates 454 by means of a laterally extending pivot axle 520 secured to on end of the cylinder and pivotally mounted in bushings 522 extending inwardly from the end plates 454. A cylinder rod 519 extending from the opposite end of fluid cylinder 518 is secured between pair of spaced upright plates 524 secured rigidly to one end of the pivot yoke 512 by a pivot pin 526. The horizontal pivot axis provided by yoke 512 and bolts and bushings 514, 516 is vertically aligned and centered above the rotational axis of auger 456 as is best seen in FIG. 5. Accordingly, operation of the fluid cylinder 518 to extend cylinder rod 519 causes clockwise rotation of the screed assembly about the axis on bolts and bushings 514, 516 raising plow 466 and lowering vibratory screed 472 or 600. However, retraction of cylinder rod 519 raises the vibratory screed 472 or 600 and lowers plow 466 by causing counterclockwise rotation around the horizontal pivot axis 514, 516. In either case, since the rotational auger is vertically aligned with the pivot axis, rotation via fluid cylinder 518 causes little or no variation in the position or height of rotational auger 456. Positioning striker/plow 466 ahead of auger 456 and vibratory screed 472 or 600 prevents "tearing" of the concrete surface which could occur if the striker/plow followed the auger. With the preferred arrangement of screed assembly 450, the grade is very accurately established and the smoothing/finishing carried out by the trailing vibratory screed 472 or 600 is considerably easier.

Fluid cylinder 518 may be controlled to automatically position screed assembly 450 on axis 514 and maintain proper contact of plow 466 and vibratory screed 472 or 600 using an electronic level sensor 530 bolted to the upper end of end plate 454 as shown in FIG. 5 or elsewhere on the screed support beam. Sensor 530 detects an out of level condition whenever screed assembly 450 rotates 0.1 degree due to the force and pressure of concrete engaging the plow 466 and tending to deflect the screed assembly and the plow downwardly thereby raising the vibratory screed 472 or 600. Detection of the rotation of 0.1 or more degree sends a signal to the electronic control circuit 532 connected to the electrical system and battery 165 as shown in FIG 5. Control box 532 in turn sends a signal to a solenoid operated hydraulic valve 534 which directs pressurized hydraulic oil to the appropriate side of fluid cylinder 518 to bring the screed assembly 450 back to a level condition and to counteract the force of the concrete exerted against plow 466. A manually adjustable flow control valve 536 is included to control the amount of fluid flow through valve 534 and thus the speed at which cylinder 518 causes rotation about axis 514. The speed is set with flow control valve 536 at a slow enough rate to assure smooth operation without overshooting. Although flow control valve 536 has a flow control range of from zero to approximately five gallons per minute, it is preferably set to allow flow to solenoid operated valve 534 at a rate of less than one cubic inch per minute. A fluid lock valve 537 is included between valve 534 and cylinder 518 to prevent undesired rotation of the screed assembly about axis 514. Although a load sensing hydraulic system including a load sensing pump 164 is shown for screeding apparatus 10, a nonload sensing system could also be used. Preferably, the level sensing unit 530 is that sold under Model No. BL-9 by Spectraphysics Construction and Agricultural Division of Dayton, Ohio. Hydraulic valve 534 is a Waterman 12DS sold by Waterman Hydraulics of Chicago, Ill.

Also, alternate power sources other than cylinders 518 may be substituted to rotate screed assembly on axis 514 such as hydraulic motors rotating threaded rods engaging pivotable members on yokes 512.

Screed assembly 450 is mounted on and controlled for elevation on screed elevation control assembly 550. As is best seen in FIGS. 1, 2, 4 and 6, elevation assembly 550 includes a rectilinear screed elevation beam 552 bolted via overcenter latches 420 to the underside of boom mount assembly 410 such that beam 552 extends perpendicular to the axial extent of boom 170. Beam 552 includes vertically extending cylindrical tubes 554, 556 on either end through which are slidably mounted inner screed elevation tubes 558, 560 on bearings pressed inside tubes 554, 556. The lower end of each inner elevation tube 558, 560 includes a tubular pivot foot 562 which is slightly smaller than the internal lengthwise dimension of pivot yoke 512 such that it may be pivotally secured inside yoke 512 by pivot bolt 564 passing through the yoke in a direction orthogonal or perpendicular to the horizontal direction of elongation of screed assembly 450 and the horizontal pivot axis provided by bolts 514 and bushings 516 described above. Pivot bolts 564 at either end of the screed assembly on screed elevation tubes 558, 560 allow the lateral tilt of the screed assembly to be adjusted by raising and lowering tubes 558, 560. Thus, the lateral incline or slope of beam 452, and thus striker/plow 466, auger assembly 456 and vibratory screed 472 or 600 mounted thereon with respect to beam 552 may be adjusted to various slopes and ground contours.

In order to raise and lower the screed assembly 450, each elevation tube 558, 560 is vertically movable by means of an extendable hydraulic cylinder 566, 568 pivotally mounted between flanges 570, 572 extending inwardly from the upper ends of inner screed elevation tubes 558, 560 and flanges 574, 576 extending inwardly from the exterior of vertically extending outer tubes 554, 556 immediately above screed elevation beam 552. When hydraulic fluid pressure is applied to the head end of cylinders 566, 568, the pistons are extended raising tubes 558, 560 along with screed assembly 450. If an incline or slope for screed assembly 450 is desired, one or the other of the tubes may be raised or lowered via cylinders 566, 568 without movement of the other. As explained below, such elevation is typically controlled automatically through a laser beacon reference control system, although manual override of such system can be accomplished through operator controlled valving on platform 112 to raise and/or lower screed assembly 450 at a different pace.

As will be understood from FIGS. 1–4, a laser beacon reference plane control system for automatically controlling the elevation of screed assembly 450 by means of elevation tubes 558, 560 is substantially similar to that used in the apparatus of U.S. Pat. No. 4,655,633. The control system includes a pair of laser receiver mounting masts 578, 580 extending vertically upwardly from elevation tubes 558, 560. A laser beacon receiver 582 is removably secured to each mast by a screw-type clamp 584. Each laser beacon receiver is preferably of the type sold under Model No. R2S or R2N by Spectraphysics Construction and Agricultural Division of Dayton, Ohio. Receivers 582 are 360 degree omni-directional receivers which detect the position of a laser reference plane such as that provided by a long-range rotating laser beacon projector of which many are available. Preferably, the projector is of the type sold under Model Nos. EL1, 1044-L or 945 also by Spectraphysics Construction and Agricultural Division of Dayton, Ohio. The projector (not shown) is preferably positioned off the screeding apparatus 10 adjacent to the area in which the concrete or other material is to be finished. The rotating laser beacon reference plane generated by the projector is received and detected by laser receivers 582 which then generate electrical signals transmitted through appropriate electrical connections including cable E extending along boom 170 to laser control circuits, one being provided for each elevation tube and hydraulic cylinder 566, 568. The control circuits are preferably of the type sold under Model No. CB20TO also by Spectraphysics. The control circuits receive and process the signals from the laser receivers 582 and transmit electrical signals to laser controlled solenoid operated hydraulic valves as described in U.S. Pat. No. 4,655,633 which are connected by appropriate hydraulic lines to hydraulic cylinders 566, 568. Accordingly, when hydraulic pressure from hydraulic pump 164 is applied to the solenoid valves, the valves allow pressure into cylinders 566, 568 as controlled by the electronic control circuits, and cylinders 566, 568 raise or lower screed assembly 450 in relation and reference to the laser beacon reference plane provided by the off vehicle projector. The control circuits provide proportional time valve outputs for driving the solenoid valves and automatic elevation control when the changes in elevation of the screed assembly 450 are minimal, but allow manual override and gross adjustment of the screed assembly elevation by the machine operator when desired. Regardless of whether the screeding operation takes place with the machine in a fixed position with boom assembly 170 being withdrawn inwardly toward the machine for screeding concrete adjacent the machine, or the machine is driven through freshly placed and/or poured concrete with the boom rotated to a position behind the vehicle and the screed assembly is fixed at a position behind the rear wheels 80 on boom 170, automatic elevation control of the screed assembly 450 will take place via the laser beacon reference control system in the above manner.

Preferred Operation And Method

As will now be understood, the screeding apparatus 10 is used to screed uncured concrete or other like materials. With either the propulsion foot pedal 157 or propulsion flow control manual valves, as well as the steering console, the vehicle is moved into position adjacent the poured, uncured concrete. Vehicle 10 is preferably moved with the boom assembly 170 retracted such that screed assembly 450 is close in to the vehicle while screed elevation cylinders 566, 568 are fully raised. The speed of the vehicle may be controlled by adjusting manual valves adjacent the operator to control the amount of hydraulic fluid passing through motors 81, 82 either in series or parallel. When in position, the upper frame 90 is rotated such that boom assembly 170 is substantially perpendicular to the left side of lower frame 12 as shown in FIGS. 1 and 3. Stabilizer cylinders **23*c*, 23*d*** are first extended such that foot pads 25 raise the left hand tires 80 slightly off the ground. Thereafter, the right side stabilizers 23*a*, 23*b* are lowered to contact their foot pads with the ground and raise the right side of the apparatus slightly more than the left side such that boom assembly 170 is at an approximate 2% grade with the tip of the boom lower than the boom support structure 172 and the boom approximately one-half way extended. Such slope allows more efficient operation of the laser operated screed elevation control system as described below. Thereafter, the flow control valves for the screed elevation cylinders 566, 568 are set to move those cylinders at a rate of about twenty-four to twenty-eight inches per minute and the laser beam projector is set up adjacent the poured concrete area of the apparatus 10. Laser receivers 582 are positioned on masts 578, 580 using clamps 584 such that they receive the laser plane projection for control of the screed elevation. In addition, the screed assembly 450 is checked to determine whether the screed strip 474 or 622 has any sags or unevenness along its length. If so, screed deflection adjustment assembly 494 is used by rotating turnbuckle assemblies 498 to increase or decrease tension on member 496 and raise or lower the various portions of the screed strip preferably using a string line such that the screed strip is trued to the string line when stretched beneath the screed. Alternately, deflection assemblies 627 or shims 634 on screed 600 are used.

Screeding is begun by actuating valve 328 (FIG. 10) with handle 329 to retract the boom slowly while controlling the speed of retraction with flow control 326. Typically, the speed of the boom retraction is set at fifteen to twenty feet per minute although this depends on the slump of the concrete, the accuracy desired and the height to which the concrete was poured. Typically strips of concrete are finished at a width of ten to eleven feet per pass using approximately a one foot overlap between strips while occasionally checking the grade with a stick or level eye between passes. Positioning the boom at approximately a 2% grade allows the screed assembly to rise slightly as it progresses toward the machine. As a result, when the screed assembly starts out on target with the projected laser beam, it will rise slightly above the target level within a short distance and the elevation control system will lower it back to the target. This pattern repeats continuously resulting in a sawtooth pattern with an approximately one-eighth inch amplitude thereby avoiding any dead band area of the screed control apparatus and more accurately controlling the elevation of the finished concrete.

As screed assembly 450 is retracted on boom assembly 170 as shown in FIG. 1, plow 466 removes excess concrete, rotational auger 456 removes and/or distributes the concrete passing beneath the plow by moving the concrete laterally with respect to the direction of movement of the boom and screed assembly, while the vibrating screed 472 or 600 consolidates and smooths the concrete. Typically, as shown in FIG. 5, screed assembly 450 is set such that vibrating screed 472 or 600 is slightly below the level of rotating auger assembly 456 although such setting does not alter the grade established by the striker/plow and auger.

During operation, the screed assembly may be deflected due to horizontal pressure of the concrete building up in front of striker/plow 466 and the slope change at the end of the boom assembly as it travels from extended to withdrawn position. Since rotational auger assembly 456 and its center line are mounted directly below pivot axis 514 of the screed assembly, auger 458 will remain on grade regardless of such angular deflection in the screed assembly. In essence, screed assembly 450 rotates about the axis of the auger during operation. Such deflection causes the plow 466 to lower slightly and the vibratory screed 472 or 600 to raise slightly relative to the auger. If such rotation is large enough the plow 466 could lower sufficiently to be below auger 458 and vibratory screed 472 or 600 will be lifted out of contact with the concrete causing inconsistent smoothing and possible "tearing" of the concrete surface.

The present invention controls this problem by automatically sensing the rotational position of screed assembly 450 with level sensor 530 which controls fluid cylinders 518 at either end of the screed assembly to cause pivotal rotation around the axis of bolts 514. Allowable rotation on the axis is ±7 degrees in the preferred embodiment although normal corrections during screeding are in the one-quarter to one and one-half degree range with correction occurring each time the screed assembly 450 rotates 0.1 degrees out of level. When sufficient rotational movement is detected by level sensor 530, a signal is sent by the sensor to control circuit 532 which in turn relays a signal to solenoid operated hydraulic valve 534 to direct pressurized hydraulic oil to the appropriate side of cylinders 518 to counteract the force of the concrete on the plow and bring the screed assembly back to a level condition. As above, since the auger is vertically aligned with axis 514 and the elevation cylinders, the position of auger 456 is substantially maintained and moves only nominally during such adjustments.

At the same time that screed assembly deflection is compensated for automatically, vibratory screed 472 or 600 is being operated with vibration shaft 484 or 636 being rotated via hydraulic motor 488 and drive assembly 490 or motor 640. Rubber mounts 478 or 610 substantially isolate all such vibration from the remainder of the screed assembly so that plow 466 and rotational auger 456 maintain efficient operation to grade, distribute and level the concrete. Simultaneously, the elevation of screed assembly 450 is constantly monitored by the laser beam receivers 582 to maintain the elevation of the screed assembly at the proper level. In addition, screed assembly 450 may be adjusted for various slopes and inclines laterally with respect to the direction of movement of the boom assembly 170 and screed assembly 450 by pivoting the screed at either end about the parallel axes provided by bolts 564 which are positioned orthogonally with respect to the axis of bolts 514. The same elevation and screed assembly rotational compensation will occur if the screed assembly is positioned behind the screed apparatus for screeding as the machine is driven through unpoured concrete. Elevation can also be controlled by a computer mounted on the operator platform and including appropriate software to vary the elevation of the screed assembly in relation to the fixed laser plane to provide vertical curves in the concrete, conical surfaces for drains, or other contours in the concrete.

While several forms of the invention have bee shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows.

1. An improved screeding apparatus for loose or plastic materials such as placed and/or poured, uncured concrete previously placed on the ground or another support surface, said apparatus being of the type including a support for supporting said apparatus on the ground or a support surface, a boom extending outwardly from said support, boom support means for mounting said boom on said support, a screed assembly, and screed mounting means for mounting said screed assembly on said boom, the improvement comprising:

said screed assembly being elongated and including a striker for engaging and spreading the material, rotatable auger means for moving the material along the direction of elongation of said screed assembly, and vibration means for engaging, vibrating and smoothing the material, said striker and vibration means being spaced on opposite sides of said auger means;

articulated means for pivotally mounting said screed assembly on a first pivot axis extending generally parallel to the direction of elongation of said screed assembly, said pivot axis being positioned generally in vertical alignment with said auger means;

motive power means for pivoting said screed assembly about said pivot axis whereby contact of said striker and vibration means with the material may be varied and adjusted.

2. The screeding apparatus of claim 1 including means for moving said elongated screed assembly along and over the material in a direction generally perpendicular to said direction of elongation whereby said motive power means allow pivoting of said screed assembly to counteract the force of the material engaging said screed assembly during movement and maintain proper screeding contact with the material.

3. The screeding apparatus of claim 2 wherein said screed mounting means includes elevation means for raising and lowering said screed assembly with respect to said boom.

4. The screeding apparatus of claim 3 wherein said articulated means include at least a second pivot axis extending in a direction perpendicular to said first pivot axis.

5. The screeding apparatus of claim 4 wherein said elevation means include a screed elevation beam rigidly mounted horizontally on said screed mounting means, spaced elevation tubes secured to said screed assembly at opposed ends of said screed elevation beam, power means for raising and lowering said elevation tubes with respect to said elevation beam, one of said elevation tubes secured to said screed assembly at one end about said first and second pivot axes, the other of said elevation tubes secured to the opposite end of said screed assembly about said first pivot axis and a third pivot axis extending parallel to said second pivot axis.

6. The screeding apparatus of claim 5 wherein said screed assembly includes a support beam; said striker, rotatable auger means and vibration means being mounted on said support beam; said articulated means extending between said elevation beam and said support beam.

7. The screeding apparatus of claim 6 wherein said motive power means include a fluid cylinder mounted on said support beam and engaging pivot yoke means attached to one of said elevation tubes for pivoting said screed assembly, said pivot yoke means providing said articulated means and one of said second and third pivot axes.

8. The screeding apparatus of claim 7 including level sensing means on said screed assembly for sensing the position and degree of rotation of said screed assembly about said first axis and control means responsive to said level sensing means for actuating said fluid cylinder to pivot said screed assembly about said first pivot axis.

9. The screeding apparatus of claim 8 including means for vibrationally isolating said vibration means from said support beam whereby said vibration means may be operated without affecting the operation of said auger means and striker.

10. The screeding apparatus of claim 3 including laser beam responsive control means on said screed assembly responsive to a fixed laser reference plane for controlling the raising and lowering of said screed assembly with said elevation means.

11. The screeding apparatus of claim 3 wherein said screed mounting means includes a generally horizontal screed elevation beam rigidly secured to said boom; said screed assembly including a support beam; said striker, rotatable auger means, and vibration means being mounted on said support beam; said articulated means extending between said elevation beam and said support beam.

12. The screeding apparatus of claim 11 including means for vibrationally isolating said vibration means from said support beam whereby said vibration means may be operated without affecting the operation of said auger means and striker.

13. The screeding apparatus of claim 12 further including means for adjustably mounting said vibration means on said support beam and means for adjusting the position of a screed member on said vibration means.

14. The screeding apparatus of claim 11 wherein said vibration means includes a pair of vertically spaced elongated supports extending across said screed assembly, resilient mounting means for mounting said supports on said support beam, an elongated screed strip mounted on the lowermost support for engaging the material, brace means for vertically spacing said supports, and rotatable shaft means mounted on said brace means and having eccentric weights thereon for vibrating said screed assembly when rotated.

15. The screeding apparatus of claim 14 wherein said elongated supports are tubular members; said apparatus including motive power means for rotating said rotatable shaft means, and means for adjusting the position of said screed strip with respect to the lowermost of said tubular members.

16. The screeding apparatus of claim 1 including level sensing means on said screed assembly for sensing the position and degree of rotation of said screed assembly about said first pivot axis and control means responsive to said level sensing means for actuating said motive power means to pivot said screed assembly about said first pivot axis.

17. The screeding apparatus of claim 16 wherein said motive power means include a fluid cylinder mounted on said screed assembly and engaging a pivot yoke mounted on said screed mounting means, said yoke including said first pivot axis and a second pivot axis extending perpendicular to said first pivot axis.

18. The screeding apparatus of claim 17 wherein said fluid cylinder and yoke are mounted at one end of said screed assembly; said motive power means including a second fluid cylinder mounted at the opposite end of said screed assembly and engaging a second pivot yoke mounted on said screed mounting means, said second yoke including said first pivot axis and a third pivot axis extending parallel to said second pivot axis.

19. The screeding apparatus of claim 18 including means for moving said elongated screed assembly along and over the material in a direction generally perpendicular to said direction of elongation whereby said motive power means allow pivoting of said screed assembly to counteract the force of the material engaging said screed assembly during movement to maintain proper screeding contact of said screed assembly with the material.

20. The screeding apparatus of claim 19 wherein said means for moving said screed include a movable boom, said boom support means including power means for moving said boom with said screed assembly thereon at a predetermined rate.

21. The screeding apparatus of claim 2 wherein said means for moving said elongated screed assembly include a telescoping boom assembly having a plurality of boom sections movable with respect to one another and with respect to said support; said screed assembly being mounted at one end of one of said boom sections; said boom support means including boom power means for extending and retracting said boom sections and said screed assembly.

22. The screeding apparatus of claim 21 wherein said boom power means include a fluid cylinder mounted on one of said boom sections and engaging said support for extending and retracting said one section with respect to said support, and pulley and cable means on said one boom section and a second boom section for extending and retracting said second boom section with respect to said one boom section and said support as said one boom section is moved with said fluid cylinder.

23. The screeding apparatus of claim 22 wherein said pulley and cable means extend and retract said second boom section with respect to said one boom section at a 2:1 ratio.

24. The screeding apparatus of claim 21 including two boom sections, one of said boom sections being larger than the second boom section, said second boom section being nested within said first boom section, said first boom section being nested within said support; bearing means on said support, said first boom section and said second boom section for movably supporting said first and second boom sections with respect to one another and said support.

25. The screeding apparatus of claim 24 including at least one flexible, hydraulic hose extending from said support to said screed assembly at said one end of said one boom section; bearing support means on at least one of said boom sections for supporting said hydraulic hose during extension and retraction of said boom sections.

26. The screeding apparatus of claim 21 wherein said means for moving said elongated screed assembly also include propulsion means on said support for moving said support and said entire screeding apparatus over the ground or support surface.

27. The screeding apparatus of claim 2 wherein said means for moving said elongated screed assembly include propulsion means on said support for moving said support and said entire screeding apparatus over the ground or support surface.

28. An improved self-propelled screeding apparatus for loose or plastic materials such as placed and/or poured, uncured concrete previously placed on the ground or another support surface, said apparatus being of the type including a frame, propulsion means on said frame for moving said frame over the ground or a support surface, a boom, boom support means for mounting said boom on said frame, a screed assembly, and screed mounting means for mounting said screed assembly on said boom, the improvement comprising:

articulated means for pivotally mounting said screed assembly on said screed mounting means on a pair of orthogonal pivot axes, said screed assembly being elongated, one pivot axis extending generally parallel to the direction of elongation of said screed assembly, and the other pivot axis extending perpendicular to said direction of elongation; and motive power means on said screed assembly for pivoting said screed assembly about said one pivot axis to control the screeding position of said screed assembly with respect to the material.

29. The screeding apparatus of claim 28 wherein said screed mounting means includes elevation means for raising and lowering said screed assembly with respect to said boom.

30. The screeding apparatus of claim 29 wherein said elevation means include a screed elevation beam rigidly mounted generally horizontally on said screed mounting means, spaced elevation tubes secured to said screed assembly at opposed ends of said screed elevation beam, power means for raising and lowering said elevation tubes with respect to said elevation beam, one of said elevation tubes secured to said screed assembly at one end about said two pivot axes, the other of said elevation tubes secured to the opposite end of said screed assembly about said one pivot axis and a third pivot axis extending parallel to said other pivot axis.

31. The screeding apparatus of claim 30 wherein said screed assembly includes a support beam, a striker on said support beam for engaging and spreading the material, horizontally extending, rotatable auger means on said support beam for moving the material along the direction of elongation of said screed assembly, and vibration means on said support beam for engaging, vibrating and smoothing the material; said articulated means extending between said elevation beam and said support beam.

32. The screeding apparatus of claim 31 wherein said motive power means include a fluid cylinder mounted on said support beam and engaging a pivot yoke attached to one of said elevation tubes, said pivot yoke providing said articulated means and one of said other and third pivot axes.

33. The screeding apparatus of claim 32 including level sensing means on said screed assembly for sensing the position and degree of rotation of said screed assembly about said one axis and control means responsive to said level sensing means for actuating said fluid cylinder to pivot said screed assembly about said one pivot axis.

34. The screeding apparatus of claim 33 including means for vibrationally isolating said vibration means from said support beam whereby said vibration means may be operated without affecting the operation of said auger means and striker.

35. The screeding apparatus of claim 34 further including means for adjustably mounting said vibration means on said support beam.

36. The screeding apparatus of claim 31 wherein said vibration means includes a pair of vertically spaced elongated supports extending across said screed assembly, resilient mounting means for mounting said supports on said support beam, an elongated screed strip mounted on the lowermost support for engaging the material, brace means for vertically spacing said supports, and rotatable shaft means mounted on said brace means and having eccentric weights thereon for vibrating said screed assembly when rotated.

37. The screeding apparatus of claim 36 wherein said elongated supports are tubular members; said apparatus including motive power means for rotating said rotatable shaft means, and means for adjusting the position of said screed strip with respect to the lowermost of said tubular members.

38. The screeding apparatus of claim 29 including laser beam responsive control means on said screed assembly responsive to a fixed laser reference plane for controlling the raising and lowering of said screed assembly with said elevation means.

39. The screeding apparatus of claim 28 wherein said means for moving said elongated screed assembly include a telescoping boom assembly having a plurality of boom sections movable with respect to one another and with respect to said support; said screed assembly being mounted at one end of one of said boom sections; said boom support means including boom power means for extending and retracting said boom sections and said screed assembly.

40. The screeding apparatus of claim 39 wherein said boom power means include a fluid cylinder mounted on one of said boom sections and engaging said frame for extending and retracting said one section with respect to said frame, and pulley and cable means on said one boom section and a second boom section for extending and retracting said second boom section with respect to said one boom section and said frame as said one boom section is moved with said fluid cylinder.

41. The screeding apparatus of claim 28 including level sensing means on said screed assembly for sensing the position and degree of rotation of said screed assembly about said one axis and control means responsive to said level sensing means for actuating said fluid cylinder to pivot said screed assembly about said one pivot axis.

42. The screeding apparatus of claim 41 wherein said screed mounting means include a generally horizontal screed elevation beam rigidly secured to said boom; said screed assembly including a support beam, a striker on said support beam for engaging and spreading the material, horizontally extending, rotatable auger means on said support beam for moving the material along the direction of elongation of said screed assembly, and vibration means on said support beam for engaging, vibrating and smoothing the material; said articulated means extending between said elevation beam and said support beam.

43. An improved self-propelled screeding apparatus for loose or plastic materials such as placed and/or poured, uncured concrete previously placed on the ground or another support surface, said apparatus being of the type including a frame, propulsion means on said frame for moving said frame over the ground or a support surface, a boom, boom support means for mounting said boom on said frame, a screed assembly, and screed mounting means for mounting said screed assembly on said boom, the improvement comprising:

said screed assembly being elongated and including a striker for engaging and spreading the material, means for moving the material along the direction of elongation of said screed assembly, and vibration means for engaging, vibrating and smoothing the material;

articulated means for pivotally mounting said screed assembly on said screed mounting means on a first pivot axis extending generally parallel to the direction of elongation of said screed assembly;

motive power means on said screed assembly for pivoting said screed assembly including said striker, said means for moving the material along the direction of elongation of said screed assembly, and said vibration means in unison about said first pivot axis; and said boom being a telescoping boom assembly including a plurality of telescoping sections and boom extension means for extending and retracting a free end of said boom by moving said sections with respect to one another, said screed assembly and screed mounting means being mounted at said free end of said boom whereby said articulated means and motive power means allow said screed assembly to be pivoted about said first pivot axis as said boom sections are moved along the material to maintain proper screeding while counteracting the force of concrete resisting movement of the screed assembly.

44. The screeding apparatus of claim 43 wherein said screed mounting means includes elevation means for raising and lowering said screed assembly with respect to said boom.

45. The screeding apparatus of claim 44 wherein said elevation means include a screed elevation beam rigidly mounted horizontally on said screed mounting means, spaced elevation tubes secured to said screed assembly at opposed ends of said screed elevation beam, power means for raising and lowering said elevation tubes with respect to said elevation beam, one of said elevation tubes secured to said screed assembly at one end about said first pivot axis and a second pivot axis extending generally perpendicular to said first axis, the other of said elevation tubes secured to the opposite end of said screed assembly about said first pivot axis and a third pivot axis extending parallel to said second pivot axis.

46. The screeding apparatus of claim 45 wherein said screed assembly includes a support beam, said striker, said means for moving the material along the direction of elongation of the screed assembly, and said vibration means being supported by said support beam, and means for vibrationally isolating said vibration means from said support beam whereby said vibration means may be operated without affecting the operation of said auger means and striker.

47. The screeding apparatus of claim 44 including laser beam responsive control means on said screed assembly responsive to a fixed laser reference plane for controlling the raising and lowering of said screed assembly with said elevation means.

48. The screeding apparatus of claim 43 wherein said boom extension means include boom power means for extending and retracting said boom sections and said screed assembly.

49. An improved self-propelled screeding apparatus for loose or plastic materials such as placed and/or poured, uncured concrete previously placed on the ground or another support surface, said apparatus being of the type including a frame, propulsion means on said frame for moving said frame over the ground or a support surface, a boom, boom support means for mounting said boom on said frame, a screed assembly, and screed mounting means for mounting said screed assembly on said boom, the improvement comprising:

said screed assembly being elongated;

articulated means for pivotally mounting said screed assembly on said screed mounting means on a first pivot axis extending generally parallel to the direction of elongation of said screed assembly;

motive power means on said screed assembly for pivoting said screed assembly about said first pivot axis; and said boom being a telescoping boom assembly including a plurality of telescoping sections and boom extension means for extending and retracting a free end of said boom by moving said sections with respect to one another, said screed assembly and screed mounting means being mounted at said free end of said boom whereby said articulated means and motive power means allow said screed assembly to be pivoted about said first pivot axis as said boom sections are moved along the material to maintain proper screeding while counteracting the force of concrete resisting movement of the screed assembly;

said boom extension means including boom power means for extending and retracting said boom sections and said screed assembly; said boom power means including a fluid cylinder mounted on one of said boom sections and engaging said frame for extending and retracting said one section with respect to said frame, and pulley and cable means on said one boom section and a second boom section for extending and retracting said second boom section with respect to said one boom section and said frame as said one boom section is moved with said fluid cylinder.

50. The screeding apparatus of claim 43 including level sensing means on said screed assembly for sensing the position and degree of rotation of said screed assembly about said first pivot axis and control means responsive to said level sensing means for actuating said motive power means to pivot said screed assembly about said first pivot axis.

51. A method of screeding material such as placed and/or poured, uncured concrete with a screed assembly comprising:

providing a screed assembly having a striker for engaging and spreading the material, means for moving the material in a lateral direction across the path of travel of said screed assembly, and vibration means for engaging, vibrating and smoothing the material;

moving the screed assembly through the material in a predetermined direction to spread, grade and smooth the material;

pivoting the striker, means for moving the material and vibration means of the screed assembly in unison about an axis perpendicular to said predetermined direction during such movement to counteract the force of the material acting on said screed assembly and to maintain effective screeding contact of said screed assembly with the material during such movement.

52. The method of claim 51 including sensing the position of said screed assembly with a sensor on said screed assembly and pivoting said screed assembly about said pivot axis in response to said sensor with a power source on said screed assembly.

53. The method of claim 51 wherein said moving step includes supporting said screed assembly on an extendable, telescoping boom assembly and retracting said boom assembly with said screed assembly thereon at a predetermined rate.

54. The method of claim 53 including moving the material in a direction lateral to said predetermined direction with said means for moving the material to form an evenly distributed layer of the material while said boom assembly and screed assembly are being retracted.

55. The method of claim 54 including vibrating said vibration means to smooth the distributed layer of material while isolating the vibration from the remainder of said screed assembly.

56. The method of claim 55 including controlling the elevation of said screed assembly with respect to a fixed reference located external to said screed assembly with a control assembly on said screed assembly.

57. The method of claim 56 wherein said control means includes a power source for raising and lowering said screed assembly; said step of controlling the elevation of said screed assembly including providing a fixed reference plane with a laser beacon positioned off the screed assembly, receiving the laser beacon with a laser beacon receiver, generating a signal indicating the position of the screed assembly relative to the reference plane with a signal means, and operating the motive power means to raise or lower the screed assembly in response to the signal from the signal means.

58. A method of screeding material such as placed and/or poured, uncured concrete with a screed assembly comprising:

moving the screed assembly through the material in a predetermined direction to spread, grade and smooth the material including supporting said screed assembly on an extendable, telescoping boom assembly, positioning said boom at approximately a 2% slope with the free end of said boom lowermost, and retracting said boom assembly with said screed assembly thereon along the upward incline provided by said 2% slope at a predetermined rate;

pivoting the screed assembly about an axis perpendicular to said predetermined direction during such movement to counteract the force of the material acting on said screed assembly and to maintain effective screeding contact of said screed assembly with the material during such movement;

moving the material with said screed assembly in a lateral direction across the path of travel to form an evenly distributed layer of the material while said boom assembly and screed assembly are being retracted;

vibrating a portion of said screed assembly to smooth the distributed layer of material while isolating the vibration from the remainder of said screed assembly; and controlling the elevation of said screed assembly with respect to a fixed reference located external to said screed assembly with a control assembly on said screed assembly.

59. The claim of claim 51 including pivoting said screed assembly about at least one additional axis which extends generally parallel to said predetermined direction during such movement whereby the lateral incline of said screed assembly is controlled.

60. The method of claim 51 including controlling the elevation of said screed assembly with respect to a fixed reference located external to said screed assembly with a control assembly on said screed assembly.

61. A vibratory screed for a screeding apparatus comprising:

an elongated, generally horizontally extending screed support;

a pair of vertically spaced, elongated beams, each beam being in one piece and extending generally horizontally across said screed support;

resilient mounting means for mounting and vibrationally isolating said beams on said screed support;

an elongated screed strip on the lowermost of said elongated beams for engaging and smoothing material such as uncured concrete;

brace means for vertically spacing said beams; and rotatable shaft means having eccentric weights thereon for vibrating said elongated screed strip when rotated.

62. The vibratory screed of claim 61 wherein said beams are tubular members; said screed also including motive power means for rotating said rotatable shaft means, and means for adjusting the position of said screed strip with respect to the lowermost of said tubular members.

* * * * *

UNITED STATES PATENT AND TRADEMARK OFFICE

CERTIFICATE OF CORRECTION

PATENT NO. : 4,930,935

DATED : June 5, 1990

INVENTOR(S) : Quenzi, et al

It is certified that error appears in the above-identified patent and that said Letters Patent is hereby corrected as shown below:

Abstract, line 13

"sassmblyis" should be -- assembly --

Column 9, line 57

"a" should be -- as --

Column 14, line 1

"boo" should be -- boom --

Column 16, line 51

"Screed 60" should be -- Screed 600 --

Column 17, line 28

"on" should be -- one --

Column 18, line 8

"on" should be -- one --

UNITED STATES PATENT AND TRADEMARK OFFICE

CERTIFICATE OF CORRECTION

PATENT NO. : 4,930,935

DATED : June 5, 1990

INVENTOR(S) : Quenzi, et al

It is certified that error appears in the above-identified patent and that said Letters Patent is hereby corrected as shown below:

Column 22, line 62

"bee" should be -- been --

Column 30, line 64

"claim" (first occurrence) should be -- method --

Signed and Sealed this

Thirty-first Day of December, 1991

*Attest:*

*Attesting Officer*

HARRY F. MANBECK, JR.

*Commissioner of Patents and Trademarks*